US010751868B2

(12) United States Patent
Tada et al.

(10) Patent No.: US 10,751,868 B2
(45) Date of Patent: Aug. 25, 2020

(54) IMPACT TOOL

(71) Applicant: MAKITA CORPORATION, Anjo-shi, Aichi (JP)

(72) Inventors: Yoshiro Tada, Anjo (JP); Masanori Furusawa, Anjo (JP); Kei Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 952 days.

(21) Appl. No.: 14/953,180

(22) Filed: Nov. 27, 2015

(65) Prior Publication Data

US 2016/0151905 A1 Jun. 2, 2016

(30) Foreign Application Priority Data

Nov. 28, 2014 (JP) ..... 2014-242373
Jun. 12, 2015 (JP) ..... 2015-119823

(51) Int. Cl.
*B25D 17/24* (2006.01)
*B25D 11/00* (2006.01)
(Continued)

(52) U.S. Cl.
CPC ..... *B25D 17/24* (2013.01); *B25D 17/043* (2013.01); *B25D 17/20* (2013.01); *B25F 5/006* (2013.01);
(Continued)

(58) Field of Classification Search
None
See application file for complete search history.

(56) References Cited

U.S. PATENT DOCUMENTS 5,692,574 A * 12/1997 Terada ..... B25D 17/043 173/162.2
5,725,304 A * 3/1998 Inai ..... B25F 5/008 366/108
(Continued)

FOREIGN PATENT DOCUMENTS

DE 19525251 A1 1/1996
DE 202008008844 U1 11/2008
(Continued)

OTHER PUBLICATIONS

Aug. 8, 2018 German Office Action issued in German Patent Application No. 102015015321.8.
(Continued)

*Primary Examiner* — Hemant Desai
*Assistant Examiner* — Tanzim Imam
(74) *Attorney, Agent, or Firm* — Oliff PLC

(57) ABSTRACT

It is an object of the invention to provide rational structure for vibration proofing in hammering operation. A driving motor 110 and a striking mechanism 140 are provided in a first body element 101*a*, and a handle 109 and a battery mounting part 160 are provided in a second body element 101*b*. The first and second body elements 101*a*, 101*b* are moved with respect to each other via a biasing member 181 when vibration is caused by driving of the striking mechanism 140. Further, a first region 100*a* close to the striking mechanism 140 forms a long-distance moving region 200 in which the first and second body elements 101*a*, 101*b* move a longer distance in a longitudinal direction than in the second region 100*b* less close to the striking mechanism 140.

19 Claims, 16 Drawing Sheets

(51) Int. Cl.
*B25D 17/04* (2006.01)
*B25D 17/20* (2006.01)
*B25F 5/00* (2006.01)

(52) U.S. Cl.
CPC ..... *B25D 2211/003* (2013.01); *B25D 2217/0061* (2013.01); *B25D 2217/0065* (2013.01); *B25D 2250/121* (2013.01); *B25D 2250/245* (2013.01); *B25D 2250/371* (2013.01)

(56) References Cited

U.S. PATENT DOCUMENTS 6,123,158 A 9/2000 Steffen
8,069,930 B2 * 12/2011 Engelfried ..... B25F 5/006 173/162.1
2003/0132016 A1 * 7/2003 Meixner ..... B25D 17/043 173/162.2
2006/0144604 A1 * 7/2006 Soika ..... B25D 16/00 173/162.2
2007/0289762 A1 * 12/2007 Kikukchi ..... B25D 17/043 173/162.1
2008/0202785 A1 * 8/2008 Fischer ..... B25D 17/24 173/162.2
2009/0314507 A1 12/2009 Iwakami
2009/0321101 A1 12/2009 Furusawa et al.
2010/0263893 A1 * 10/2010 Fischer ..... B25D 17/043 173/162.2
2011/0308828 A1 * 12/2011 Shinma ..... B25F 5/008 173/114
2012/0031639 A1 * 2/2012 Roberts ..... B25D 17/043 173/162.2
2014/0318821 A1 10/2014 Wyler et al.

FOREIGN PATENT DOCUMENTS

JP 2006175588 A 7/2006
JP 2010-000567 A 1/2010
JP 2010-005751 A 1/2010
JP 2014-138971 A 7/2014

OTHER PUBLICATIONS

Jan. 8, 2019 Office Action issued in Japanese Patent Application No. 2015-119823.
Sep. 17, 2018 Office Action issued in Chinese Patent Application No. 201510845495.2.
Sep. 26, 2018 Office Action issued in Japanese Patent Application No. 2015-119823.
Mar. 19, 2019 Office Action issued in Chinese Patent Application No. 201510845495.2.
Oct. 9, 2019 Office Action issued in Chinese Patent Application No. 201510845495.2.

* cited by examiner

IMPACT TOOL

TECHNICAL FIELD

The present invention relates to an impact tool which performs a hammering operation on a workpiece.

BACKGROUND ART

Japanese non-examined laid-open Patent Publication No. 2006-175588 discloses an impact tool having a striking mechanism that moves a tool accessory in the direction of a striking axis, a transmission housing that holds the striking mechanism, and a housing that is provided with a handle designed to be held by a user. In this impact tool, the transmission housing and the housing are connected by two elastic members and thus moved with respect to each other in the direction of the striking axis, so that vibration which is caused by driving of the striking mechanism is reduced.

SUMMARY OF THE INVENTION

Problem to be Solved by the Invention

Relatively large vibration is caused along the striking axis by driving of a striking mechanism. Therefore, the above-described mechanism that moves the transmission housing and the housing with respect to each other in the direction of the striking axis has a certain level of vibration reducing effect. In the impact tool, however, vibration which cannot be prevented by this mechanism remains. Therefore, further improvement is desired.

Accordingly, it is an object of the present invention to provide a further rational structure for vibration proofing in actual hammering operation.

Means for Solving the Problem

Above-described problem is solved according to the invention. An impact tool according to the invention is provided to perform a hammering operation on a workpiece by linearly driving a tool accessory. An example of the impact tool is an electric hammer capable of breaking a workpiece such as concrete by linearly moving the tool accessory.

The impact tool has a body, a tool accessory mounting part that extends in a prescribed longitudinal direction, a driving motor that has an output axis crossing the longitudinal direction, a striking mechanism that is driven by output of the driving motor and has a striking axis parallel to the longitudinal direction, a handle designed to be held by a user and a battery mounting part on which a battery for supplying current to the driving motor is mounted. The output axis is defined by an extending direction of a shaft of the driving motor. An example of the striking mechanism is a structure consisting of a piston that is caused to linearly reciprocate by the driving motor, a striking element, and an air chamber that is formed between the piston and the striking element. In this case, when the piston is moved toward the tool accessory, air within the air chamber is compressed. When the compressed air expands, the striking element is moved and collides with the tool accessory, so that the tool accessory is moved in the longitudinal direction. Further, when the piston is moved in the opposite direction away from the tool accessory, air within the air chamber is expanded, and then the striking element is moved in the opposite direction away from the tool accessory as the expanded air contracts. By such reciprocating movement of the piston, the tool accessory is linearly moved. Further, in the impact tool according to the present invention, an intermediate element may be appropriately provided between the striking element and the tool accessory. When the striking element has the above-described structure, a direction in which the piston reciprocates defines the striking axis. The striking axis is parallel to the longitudinal direction. In this case, it is only necessary for the striking axis to pass through any region on the piston. Further, the striking axis which passes through a center of the tool accessory when the tool accessory is mounted on the tool accessory mounting part is particularly referred to as a central striking axis.

In the impact tool according to this aspect, the body has a first body element, a second body element and a biasing member that biases the first and second body elements.

The biasing member can be formed by a spring element such as a coil spring. When using a coil spring as the biasing member, one end of the coil spring is fixed to the first body element and the other end is fixed to the second body element, so that the coil spring can bias the first and second body elements.

The biasing member preferably biases the first and second body elements in a direction away from each other. With such a structure, when the first and second body elements move toward each other, the first and second body elements can be effectively prevented from colliding with each other. As a result, damage of the body which may be caused by this collision can be prevented.

Further, the body has a first region close to the striking mechanism and a second region less close to the striking mechanism than the first region. Being "close to" or "less close to" the striking mechanism can be defined, for example, by the straight-line distance of each line connecting any two points on the body and a prescribed point on the striking mechanism in a direction crossing the longitudinal direction. Specifically, in the direction crossing the longitudinal direction, a region of the body including one of the points on the body which is closer to the prescribed point on the striking mechanism than the other point can be defined as the first region, and a region of the body including the other point can be defined as the second region.

Further, the driving motor and the striking mechanism are provided in the first body element, and the handle and the battery mounting part are provided in the second body element.

The impact tool according to this aspect further has a vibration-proofing mechanism for reducing vibration which is caused by driving of the striking mechanism. The vibration-proofing mechanism causes the first and second body elements to reciprocate away from and toward each other via the biasing member when vibration is caused by driving of the striking mechanism.

The state in which the first and second body elements are away from each other or close to each other is now explained. First, any point on the first body element and any point on the second body element in the longitudinal direction are prescribed. A distance between the prescribed points of the first and second body elements is defined as a first position defining distance. Next, when the first and second body elements are moved with respect to each other, the distance between the prescribed points of the first and second body elements is defined as a second position defining distance. Here, the first position defining distance is assumed to be longer than the second position defining distance. In this case, the first and second body elements are "away from each other" when forming the first position defining distance, while the first and second body elements are "close to each other" when forming the second position defining distance.

In the impact tool according to this aspect, the first region forms a long-distance moving region in which the first and second body elements move a longer distance toward each other in the longitudinal direction than in the second region.

In the impact tool according to this aspect, with such a structure, where the first region which receives a strong influence of vibration from the striking mechanism forms the long-distance moving region as described above, effective vibration proofing can be achieved. Further, it can be said that the second region forms a short-distance moving region in which the first and second body elements move a shorter distance toward each other in the longitudinal direction than in the first region. Specifically, having both the long-distance moving region and the short-distance moving region, the vibration-proofing mechanism can effectively reduce vibration which is caused by driving of the striking mechanism.

In another aspect of the impact tool according to the present invention, the impact tool has a center of gravity with the battery mounted on the battery mounting part, and the first and second body elements are configured to rotate around a rotation axis with respect to each other.

In this structure, the rotation axis can be provided closer to the center of gravity than to the striking axis. Further, the state in which the rotation axis is closer to the center of gravity than to the striking axis means that, for example, when a virtual line perpendicular to the striking axis and passing through the center of gravity and an intersection point of this virtual line and the striking axis are defined, the distance between the rotation axis and the center of gravity is shorter than the distance between the rotation axis and the above-described intersection point. With such a structure, the distance of movement of the first and second body elements in the long-distance moving region (the first region) can be increased.

Further, part of vibration which is caused by driving of the striking mechanism may change into vibration in a direction of rotation around the center of gravity of the impact tool. In such a case, with this structure, vibration in the direction of rotation of the impact tool can be effectively reduced.

In another aspect of the impact tool according to the present invention, the first body element may have a first covered region that is covered by the second body element and an exposed region that is not covered by the second body element. Specifically, the first body element and the second body element form an overlapping region where they overlap each other. In the overlapping region, a covering side forms an exposed region and a covered side forms a covered region. Further, the exposed region can form an outer shell of the impact tool. In this sense, the exposed region does not necessarily have to cover the other body element.

In such a structure, the driving motor can be provided in the first covered region. Specifically, the driving motor is protected by the second body element inside the impact tool.

In another aspect of the impact tool according to the present invention, the driving motor may be disposed in a motor holding part. In this case, the first body element may be integrated with the motor holding part. Integrating the first body element and the motor holding part with each other means fixing the motor holding part to the first body element by a fastening member or other means so that the motor holding part moves together with the first body element with respect to the second body element when the first body element moves with respect to the second body element.

Such a structure can facilitate assembling the driving motor to the first body element.

In another aspect of the impact tool according to the present invention, a pivot member for defining the rotation axis may be formed in the motor holding part. In this case, the rotation axis can be formed by fixing the motor holding part having the pivot member to the first body element, so that higher efficiency in manufacturing can be realized.

In another aspect of the impact tool according to the present invention, the second body element may have a second covered region which is covered by the first body element. In this case, an edge region of the second body element on the tool accessory holding part side may form the second covered region.

In hammering operation, dust of the workpiece which is generated during operation of the tool accessory scatters from the tool accessory toward the handle. In such a condition, inflow of the dust into the second body element can be effectively prevented by forming a region of the second body element on the tool accessory holding part side as the second covered region. In this sense, it can be said that the second covered region and a region of the first body element covering the second covered region form a dust-proofing mechanism.

In another aspect of the impact tool according to the present invention, a direction in which the biasing member biases the first and second body elements may coincide with the striking axis. With this structure, the biasing member easily receives vibration which is caused in the direction of the striking axis by driving of the striking mechanism, so that more efficient movement of the first and second body elements with respect to each other can be promoted.

Further, the biasing direction of the biasing member can be made to coincide with the striking axis typically by disposing the biasing member coaxially with the central striking axis. Even in a structure in which the biasing member is not disposed coaxially with the central striking axis, however, it is only necessary to arrange part of the biasing member on the striking axis.

Further, the biasing member may be arranged such that its axis extends in parallel to the striking axis, or its axis extends in a direction crossing the striking axis, or the biasing member may be curved to be coaxially arranged or overlapped with the striking axis.

In another aspect of the impact tool according to the present invention, the impact tool may have a restricting part for restricting movement of the first and second body elements toward each other. The restricting part is formed inside the body. In this case, the outer shells (the above-described exposed regions) of the first and second body elements can be prevented from colliding with each other.

In this sense, it can be said that the restricting part forms a collision preventing mechanism for preventing collision between the exposed regions of the first and second body elements.

In another aspect of the impact tool according to the present invention, the restricting part may also serve as a guide for guiding movement of the first and second body elements with respect to each other. The guide can be configured to guide the first and second body elements to slide in contact with prescribed regions of the first and second body elements. By providing the restricting part to be also used as the guide, the structure can be made mechanically simple, and the first and second body elements can be easily assembled together.

In another aspect of the impact tool according to the present invention, the driving motor may have an intake port in one end region and an exhaust port in the other end region. Further, the body may have an air circulation preventing mechanism. The air circulation preventing mechanism may be provided between the intake port and the exhaust port inside the body and configured to prevent circulation of air between the intake port and the exhaust port.

Further, in order to promote intake of air from the intake port and discharge of the air from the exhaust port, a fan may be provided on the shaft of the driving motor. Moreover, in the second body element which covers the driving motor, a body intake port may be provided in a region closer to the intake port than to the exhaust port and a body exhaust port may be provided in a region closer to the exhaust port than to the intake port.

In the present invention, the driving motor is configured to be moved together with the first body element with respect to the second body element. Therefore, a space is formed between the driving motor and the second body element covering the driving motor so as to allow the driving motor and the second body element to rotate with respect to each other. The space may be referred to as a rotation allowing space. Air taken in from the intake port through the body intake port is heated by heat of the inside of the driving motor and discharged from the exhaust port. Depending on the structure of the rotation allowing space, however, air discharged from the exhaust port may flow upward in the rotation allowing space without being discharged from the body exhaust port and may be sucked in through the intake port again. In the impact tool according to this aspect of the invention, by providing the air circulation preventing mechanism, such an occurrence (air circulation in the rotation allowing space) in which air discharged from the exhaust port is sucked in again through the intake port can be prevented, so that cooling of the driving motor can be promoted.

In another aspect of the impact tool according to the present invention, the air circulation preventing mechanism may be formed by a wall-like member. In this case, the wall-like member blocks flow of discharged air from the exhaust port to the intake port. Specifically, air discharged from the exhaust port is discharged from the body exhaust port without returning to the intake port again. Further, the wall-like member is formed to extend from the second body element covering the driving motor or from the motor holding part. In this case, the wall-like member may be formed to integrally extend from a prescribed region of the second body element or the motor holding part. Alternatively, the wall-like member may be formed separately from the second body element or the motor holding part and mounted to a prescribed region of the second body element or the motor holding part.

Further, the rotation axis may be located on an extension plane of the wall-like member. The wall-like member has surfaces opposed to each other and an intermediate part located between the opposed surfaces. In this sense, assuming that the wall-like member is extended, the extension plane of the wall-like member is defined as a plane which is parallel to the extending direction of the wall-like member and passes through any one of the opposed surfaces and the intermediate part of the wall-like member. The rotation allowing space around a distal end of the wall-like member can be narrowed by locating the extension plane of the wall-like member on the rotation axis around which the first and second body elements rotate. Therefore, air flowing from the exhaust port toward the intake port can be efficiently blocked.

The wall-like member does not have to be provided over the entire periphery of the driving motor. For example, in regions of the second body element and the driving motor which are located on the rotation axis, it is not necessary to provide the rotation allowable space which allows relative rotation of the first and second body elements. Therefore, in these regions, the second body element and the driving motor can be disposed adjacent to each other, so that the wall-like member does not have to be provided in these regions. In the case of this structure, it can be said that the regions of the second body element and the driving motor which are located on the rotation axis form the air circulation preventing mechanism.

In this structure, the wall-like member can be provided in a region which is perpendicular to the rotation axis and the output axis of the driving motor and overlaps with the rotation axis.

In another aspect of the impact tool according to the present invention, the first and second body elements have an overlap region where they overlap each other. More specifically, the overlap region is formed by a first exposed region and the second covered region or by the first covered region and a second exposed region. Thus, the above-described overlapping region forms the overlap region.

The overlap region has a flexible member which is disposed in one of the first and second body elements. The flexible member forms the entirety or part of the covered region or exposed region by being disposed in the first body element or the second body element. More specifically, the flexible member is disposed in any one of the first covered region, the first exposed region, the second covered region and the second exposed region. The flexible member can be formed by an elastomer material.

The overlap region has a sliding region which is formed in the other of the first and second body elements and which comes in sliding contact with the flexible member when the first and second body elements reciprocate with respect to each other. Specifically, the sliding region is disposed in any one of the first covered region, the first exposed region, the second covered region and the second exposed region where the flexible member is not disposed. In other words, the sliding region is formed in a flexible member non-arrangement region.

According to the impact tool of this aspect, the flexible member is disposed in one of the first and second body elements in the overlap region, and the sliding region is formed in the other of the first and second body elements. With such a structure, a gap formed between the first and second body elements in the overlap region is closed by the flexible member. Therefore, the flexible member can prevent dust generated during operation from entering the body. In this sense, it can be said that the flexible member and the sliding region form a dust-proofing mechanism.

In another aspect of the impact tool according to the present invention, the flexible member may form one of the first and second covered regions. In this case, the one of the first covered region and the second covered region may be formed only by the flexible member. Further, the first covered region or the second covered region may be formed by the flexible member and the first body element or the second body element.

In another aspect of the impact tool according to the present invention, the flexible member may be formed in the second body element.

In another aspect of the impact tool according to the present invention, the flexible member may be configured to be elastically deformed by the first or second body element having the sliding region when the first and second body elements are assembled together. In this case, the first body element may have a cylindrical region having an opening, while the second body element may have an insertion region which is inserted into the cylindrical region through the opening when assembled. In this structure, upon completion of assembling, a region of the second body element which is inserted into the first body element forms the second covered region and a peripheral region of the opening of the first body element which covers the second covered region forms the first exposed region. Further, the striking mechanism is housed in the cylindrical region.

In the impact tool according to this aspect of the invention, the flexible member deforms when the second body element is inserted into the first body element, so that the assembling operation can be easily performed.

Further, the second body element can be formed to have a two-split structure consisting of two second body elements. In this structure, first, one of the second body elements is assembled to the first body element, and then the other second body element is assembled to the first body element and the one second body element. At this time, for example, in the structure in which the flexible member is disposed in the insertion region of the other second body element, when the insertion region of the other second body element is inserted into the opening of the first body element, the flexible member comes in contact with the opening peripheral region and deforms. Therefore, the other second body element can be easily assembled to the first body element. Further, when the deformed flexible member of the other second body element is inserted into the cylindrical region, the other second body element is further moved toward the first body element while being guided by the deformed flexible member. Therefore, the other second body element can be smoothly assembled to the first body element. In this sense, it can be said that the flexible member forms a guide for assembling the first and second body elements.

In another aspect of the impact tool according to the present invention, the flexible member may be integrally formed with the one of the first and second body elements in the overlap region.

In the impact tool according to this aspect of the invention, the flexible member can be easily formed.

Further, a slip stopper formed of elastomer may be provided on the handle of the second body element. In such a case, the slip stopper can be formed contiguously to the flexible member, and the second body element can be integrally formed with the slip stopper and the flexible member. In this structure, the second body element, the flexible member and the slip stopper can be easily formed.

Effect of the Invention

According to the present invention, a further rational structure for vibration proofing in actual hammering operation is provided.

REPRESENTATIVE EMBODIMENT OF THE INVENTION

Figure 1:
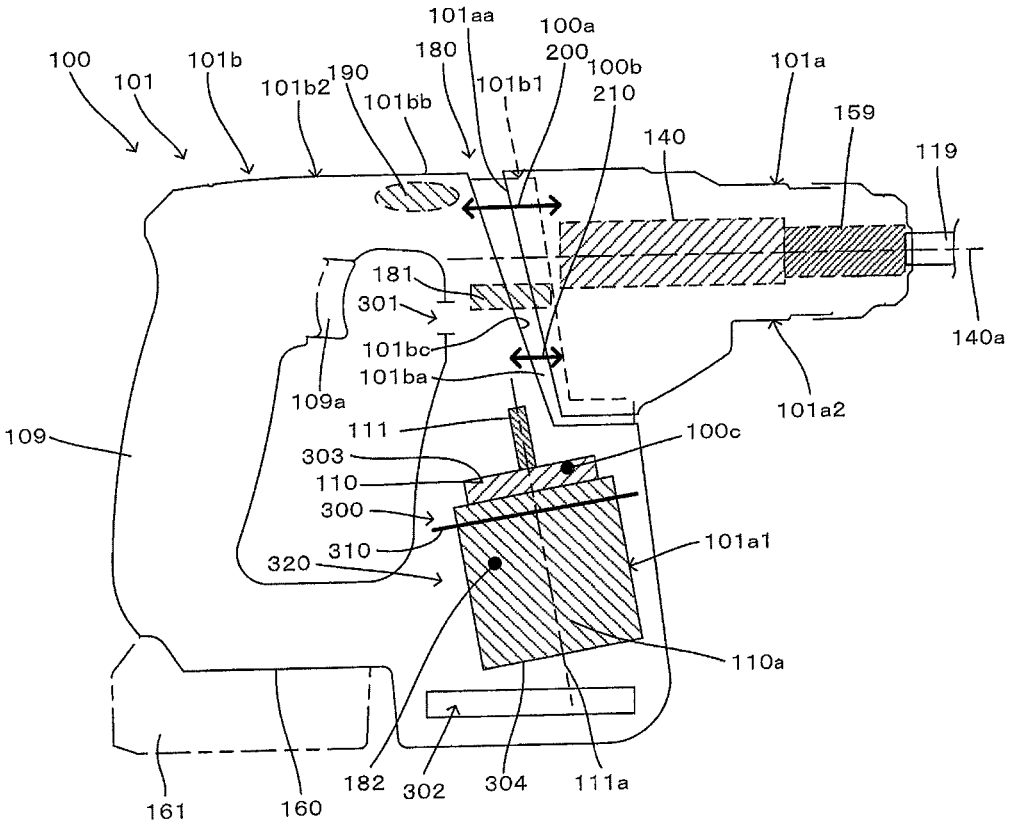
FIG. 1 is an explanatory drawing for schematically showing an impact tool according to a first embodiment of the present invention.
Figure 7:
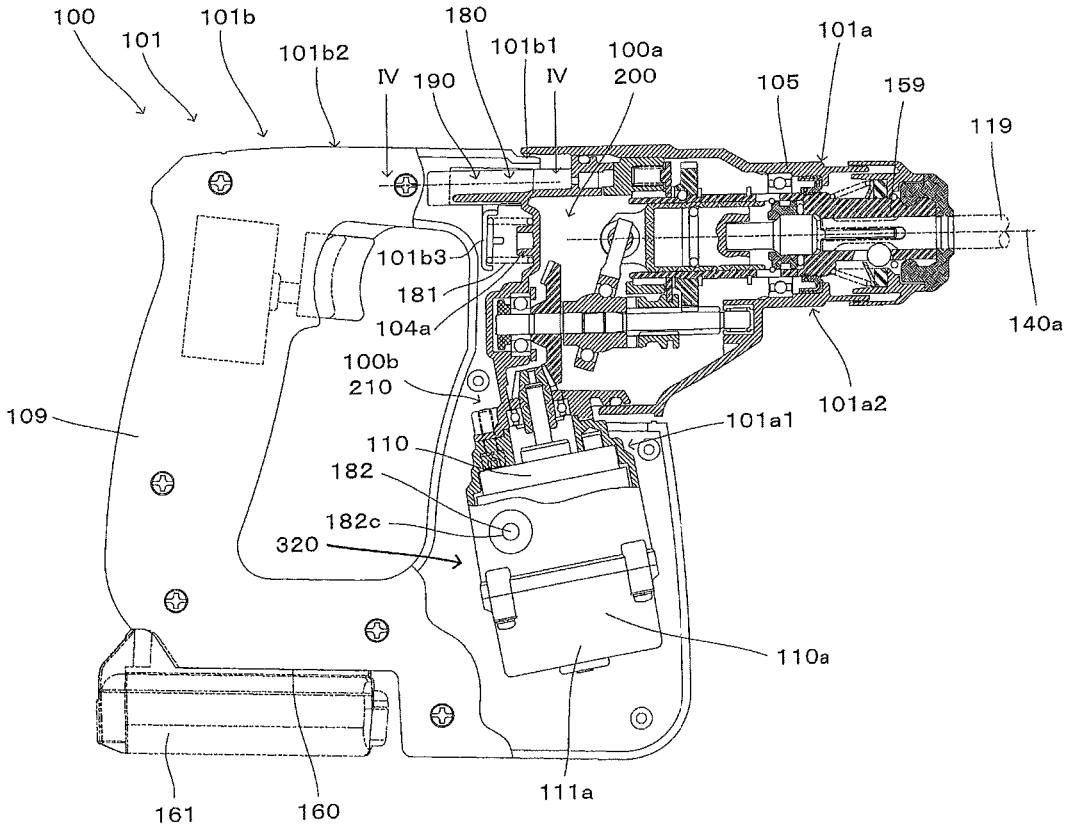
FIG. 7 is an explanatory drawing for illustrating an operation of the impact tool.
Figure 8:
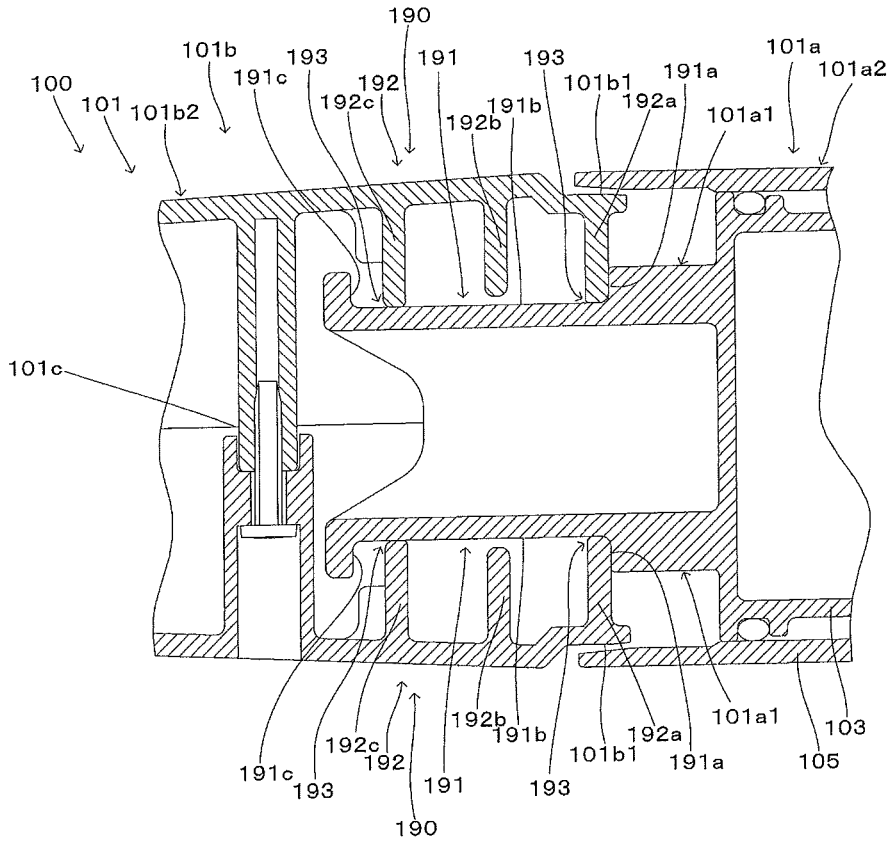
FIG. 8 is a sectional view taken along line IV-IV in FIG. 7.
Figure 9:
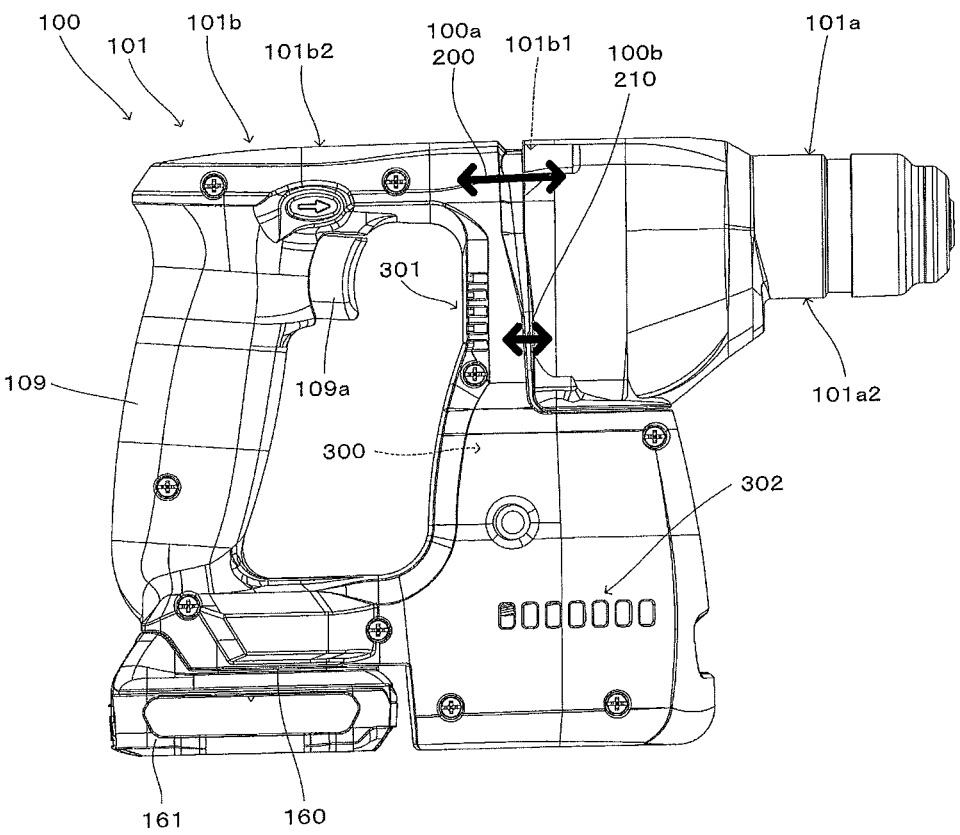
FIG. 9 is an explanatory drawing showing an external appearance of an impact tool according to a third embodiment of the present invention.
Figure 10:
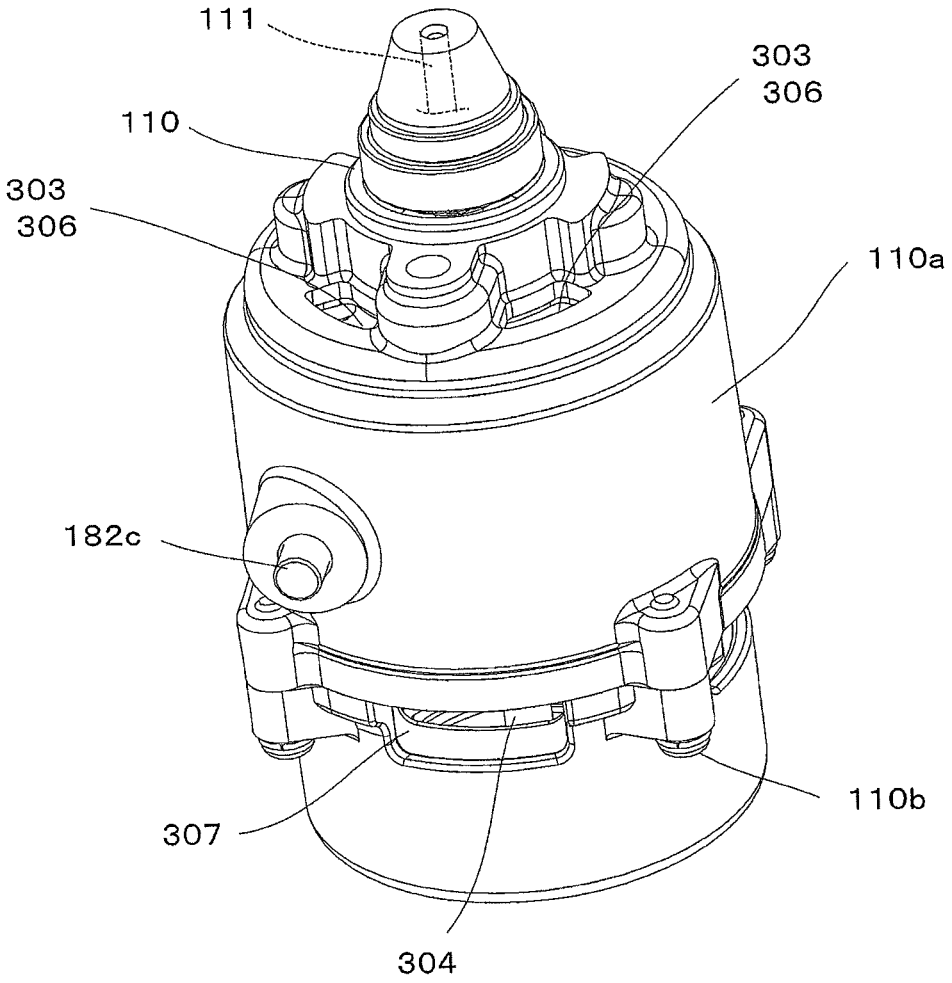
FIG. 10 is a perspective view showing a driving motor in the impact tool.
Figure 11:
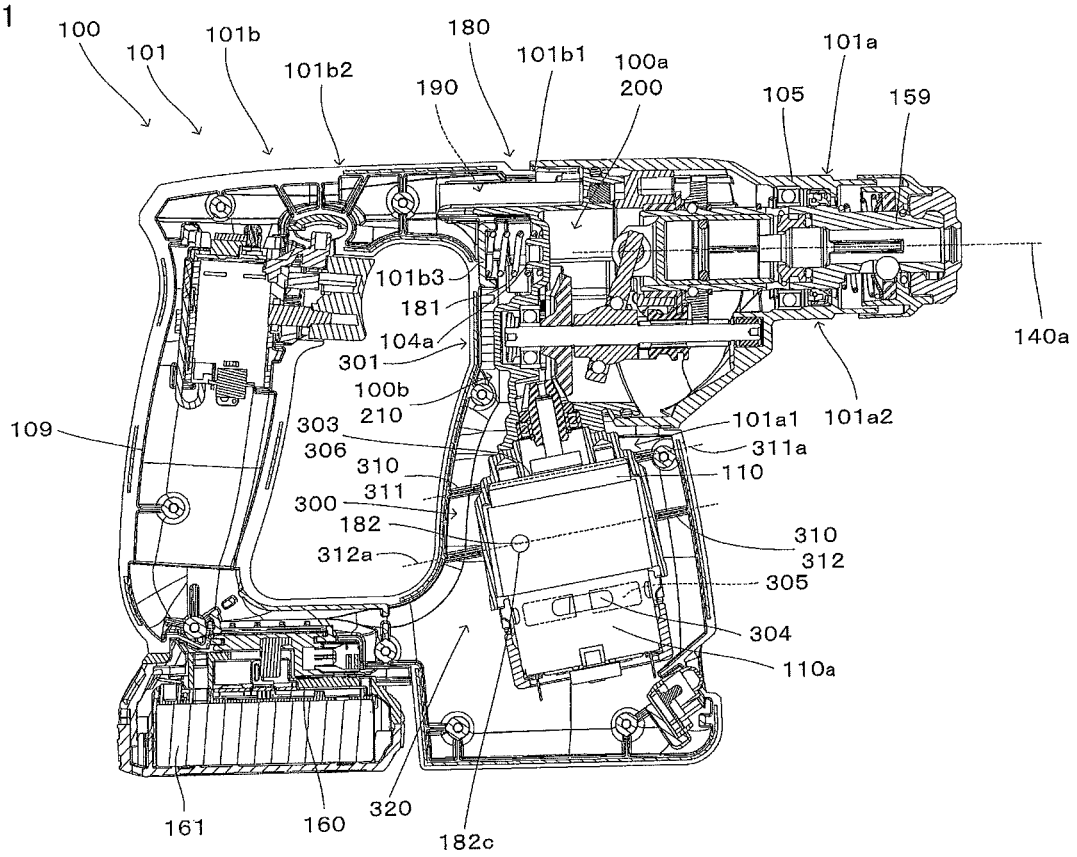
FIG. 11 is an explanatory drawing for illustrating an air circulation preventing mechanism in the impact tool.
Figure 12:
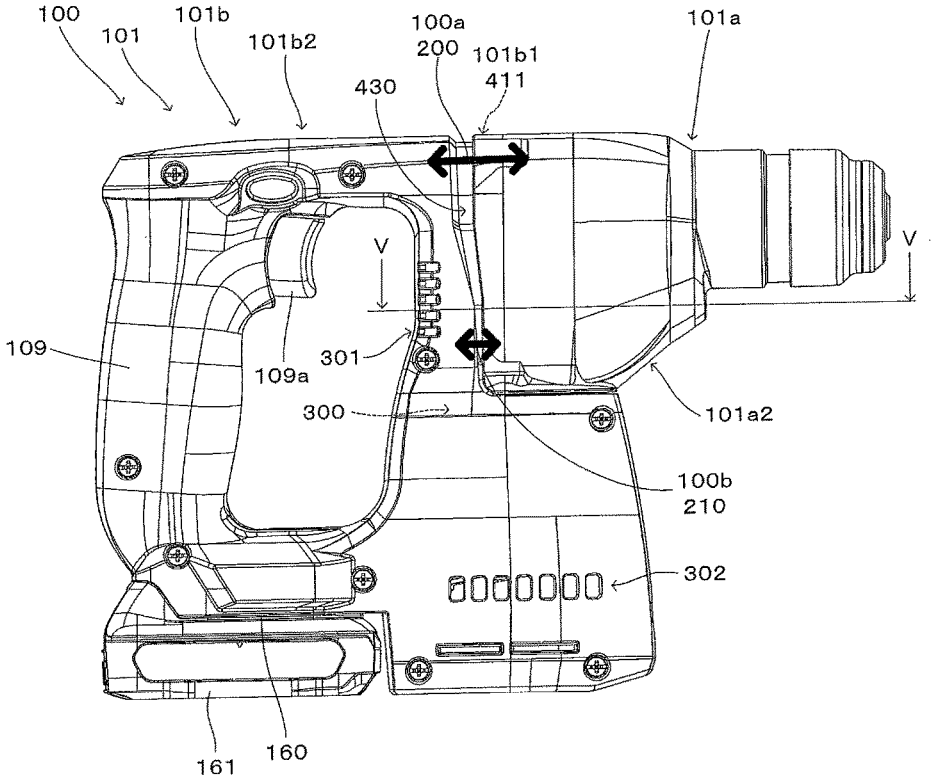
FIG. 12 is an explanatory drawing showing an external appearance of an impact tool according to a fourth embodiment of the present invention.
Figure 13:
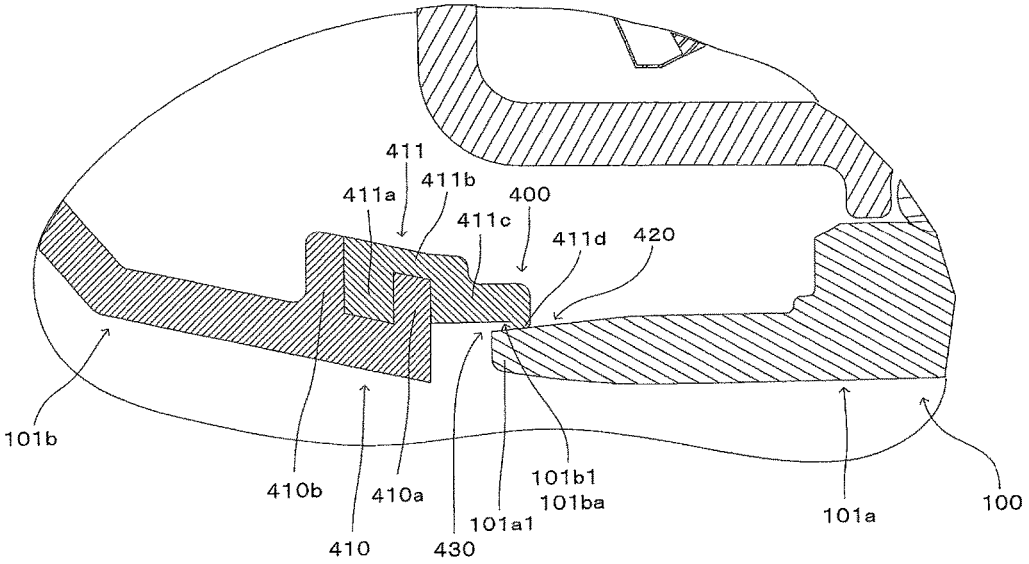
FIG. 13 is a sectional view taken along line V-V in FIG. 12.
Figure 14:
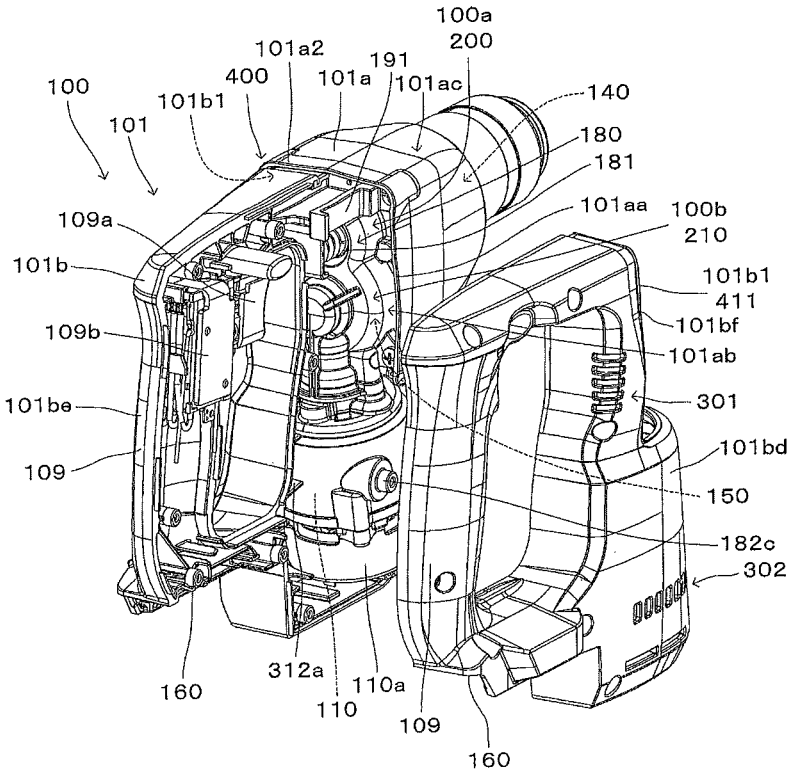
FIG. 14 is an explanatory drawing for illustrating assembling of the impact tool.
Figure 15:
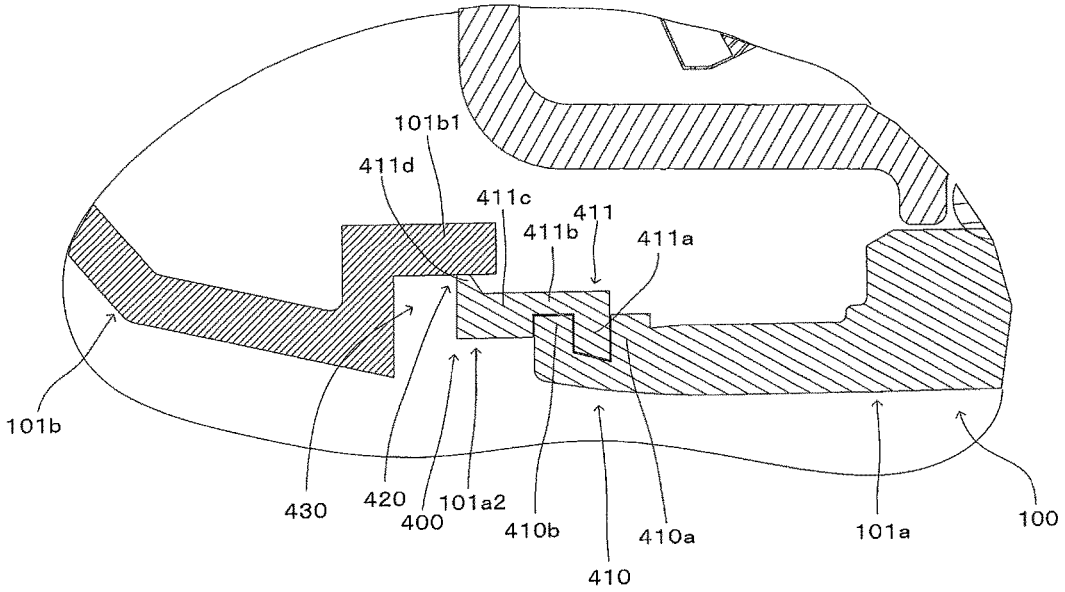
FIG. 15 is an explanatory drawing showing an overlap region of an impact tool according to a fifth embodiment of the present invention.
Figure 16:
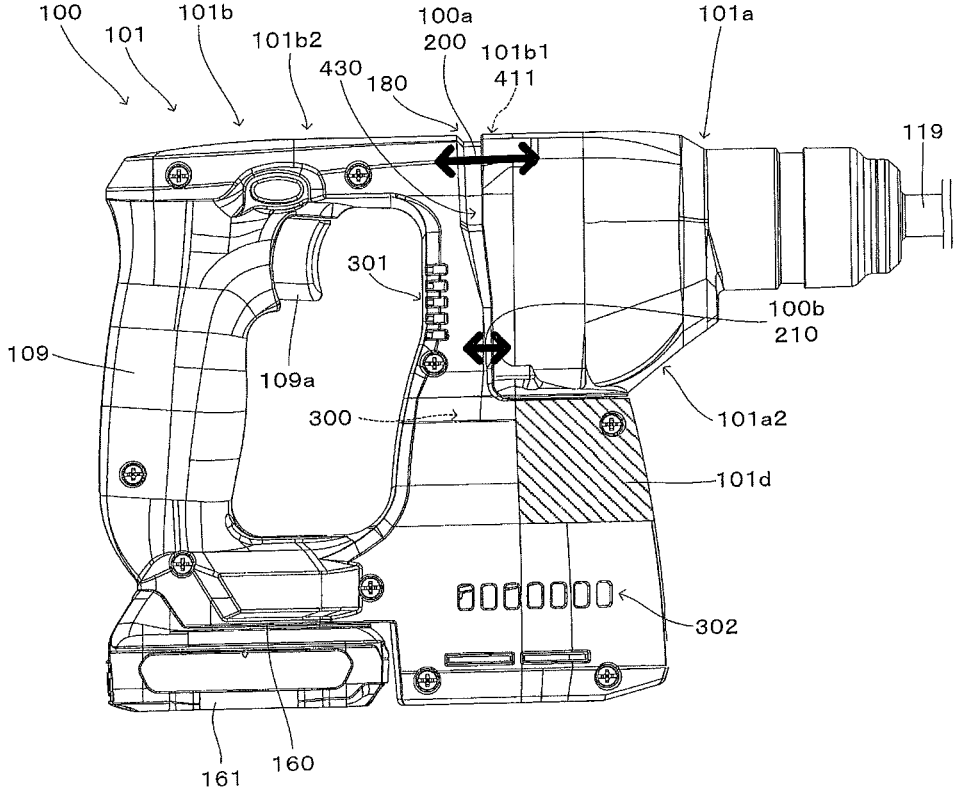
FIG. 16 is an explanatory drawing showing an external appearance of an impact tool according to a sixth embodiment of the present invention.

An impact tool according to first to sixth embodiments is now described with reference to FIGS. 1 to 16. FIG. 1 shows the first embodiment, FIGS. 2 to 8 show the second embodiment, FIGS. 9 to 11 show the third embodiment, FIGS. 12 to 14 show the fourth embodiment, FIG. 15 shows the fifth embodiment and FIG. 16 shows the sixth embodiment. In the description of the first to sixth embodiments, parts or mechanisms having identical or similar functions are given the same designations and reference signs and may not be described.

First Embodiment of the Invention

The first embodiment according to the present invention is explained with reference to FIG. 1. In the first embodiment, a general structure relating to the structures of the second to sixth embodiments is described in detail.

An impact tool 100 has a tool accessory mounting part 159 for mounting a tool accessory 119 and a battery mounting part 160 for mounting a battery 161, and performs a hammering operation on a workpiece by linearly driving the tool accessory 119. The tool accessory mounting part 159 is configured such that the tool accessory 119 is detachably mounted thereto. A longitudinal direction of the tool accessory mounting part 159 defines a longitudinal direction of the impact tool 100. The longitudinal direction is parallel to a drive axis of the tool accessory on which the tool accessory is driven. Further, the battery mounting part 160 is configured such that the battery 161 can be removably mounted thereto.

For the sake of explanation, in the longitudinal direction, a front side of the tool accessory mounting part 159 is defined as a front side and a side opposite to the front side is defined as a rear side. Further, in a direction crossing the longitudinal direction, the tool accessory mounting part 159 side is defined as an upper side and the battery mounting part 160 side is defined as a lower side. In this definition, the right, left, upper and lower sides in FIG. 1 correspond to front, rear, upper and lower sides in the impact tool 100, respectively.

The impact tool 100 has a body 101, the tool accessory mounting part 159, a driving motor 110 which has an output axis 111*a* crossing the longitudinal direction and is driven by a current supplied from the battery 161, a striking mechanism 140 which is driven by output of the driving motor 110, a handle 109 designed to be held by a user and the battery mounting part 160. The output axis 111*a* is defined by an extending direction of a shaft 111 of the driving motor 110. Further, when the battery 161 is mounted on the battery mounting part 160, a center of gravity 100*c* of the impact tool 100 is designed to be located on the driving motor 110. The handle 109 is provided with a trigger 109*a* which is operated by the user in order to control the amount of current to be supplied from the battery 161 to the driving motor 110.

The body 101 mainly includes a first body element 101*a* and a second body element 101*b*. The driving motor 110 and the striking mechanism 140 are provided in the first body element 101*a*, and the handle 109 and the battery mounting part 160 are provided in the second body element 101*b*. The driving motor 110 is surrounded by a motor holding part 110*a* and the motor holding part 110*a* is disposed in the first body element 101*a*. With such a structure, the first body element 101*a* and the driving motor 110 are integrated with each other.

The first body element 101*a* and the second body element 101*b* have an exposed region exposed to the outside of the impact tool 100. Further, the first body element 101*a* and the second body element 101*b* form an overlapping region where they are overlaid one on the other (they overlap each other). In the overlapping region, a covering side forms an exposed region and a covered side forms a covered region. In the overlapping region, a region of the first body element 101*a* which is covered by the second body element 101*b* forms a first covered region 101*a*1, and a region of the second body element 101*b* which is covered by the first body element 101*a* forms a second covered region 101*b*1. Further, a region of the first body element 101*a* which is not covered by the second body element 101*b* forms a first exposed region 101*a*2, and a region of the second body element 101*b* which is not covered by the first body element 101*a* forms a second exposed region 101*b*2.

The driving motor 110 is disposed in the first covered region 101*a*1. Specifically, the driving motor 110 is covered by the second exposed region 101*b*2.

Further, the second body element 101*b* has an open front end region 101*ba* including an opening formed on the front end. A region of the second body element 101*b* which does not have the open front end region 101*ba* forms a main region 101*bb*. A rear edge 101*aa* of the first body element 101 covers a front edge of the open front end region 101*ba*. Specifically, an edge region of the second body element 101*b* on the tool accessory holding part 159 side forms the second covered region 101*b*1. With such a structure, dust which scatters from the tool accessory 119 toward the handle 109 during hammering operation can be prevented from entering the second body element 101*b*2. In this sense, it can be said that a region of the first body element 101*a* including the rear edge 101*aa* and the second covered region 101*b*1 covered thereby form a dust-proofing mechanism 430. Further, it can be said that, as the dust-proofing mechanism 430, the front end region of the second body element 101*b* forms an insertion region which is inserted into the first body element 101*a*.

A stepped part 101*bc* is formed in the boundary between the open front end region 101*ba* and the main region 101*bb*.

The impact tool 100 has a vibration-proofing mechanism 180 for reducing vibration which is caused by driving of the striking mechanism 140. The vibration-proofing mechanism 180 causes the first and second body elements 101*a*, 101*b* to reciprocate away from and toward each other when vibration is caused by driving of the striking mechanism 140.

An example of the striking mechanism 140 is a structure consisting of a piston that is caused to linearly reciprocate by the driving motor 110, a striking element and an air chamber that is formed between the piston and the striking element. In this case, when the piston is moved toward the tool accessory, air within the air chamber is compressed. When the compressed air expands, the striking element is moved and collides with the tool accessory, so that the tool accessory is moved. Further, when the piston is moved in the opposite direction away from the tool accessory, air within the air chamber is expanded, and then the striking element is moved in the opposite direction away from the tool accessory as the expanded air contracts. By such reciprocating movement of the piston, the tool accessory is linearly moved along the drive axis of the tool accessory. Further, an intermediate element may be provided between the striking element and the tool accessory 119. When the striking element 140 having such a structure is driven, vibration is caused in the longitudinal direction. Further, a direction in which the piston reciprocates defines a striking (hammering) axis. It is only necessary for the striking axis to pass through any region on the piston. Further, the striking axis which passes through a center of the tool accessory 119 when the tool accessory 119 is mounted on the tool accessory mounting part 159 is particularly referred to as a central striking axis 140*a*.

The body 101 has a first region 100*a* close to the striking mechanism 140 and a second region 100*b* less close to the striking mechanism 140 than the first region 100*a*. Being "close to" or "less close to" the striking mechanism 140 can be defined, for example, by the straight-line distance of each line connecting any two points on the body 101 and a prescribed point on the striking mechanism 140 in a direction crossing the longitudinal direction. Specifically, in the direction crossing the longitudinal direction, a region of the body 101 including one of the points on the body 101 which is closer to the prescribed point on the striking mechanism 140 than the other point can be defined as the first region 100*a*, and a region of the body 101 including the other point can be defined as the second region 100*b*.

The first region 100*a* forms a long-distance moving region 200 in which the first and second body elements 101*a*, 101*b* move a longer distance toward each other in the longitudinal direction than in the second region 100*b*. With such a structure, where the first region 100*a* which receives a strong influence of vibration from the striking mechanism 140 forms the long-distance moving region 200, effective vibration proofing can be achieved. Further, it can be said that the second region 100*b* forms a short-distance moving region 210 in which the first and second body elements 101*a*, 101*b* move a shorter distance toward each other in the longitudinal direction than in the first region 100*a*. Specifically, having both the long-distance moving region 200 and the short-distance moving region 210, the vibration-proofing mechanism 180 can effectively reduce vibration occurring in various directions.

Here, the state in which the first and second body elements 101*a*, 101*b* are "away from each other" or "close to each other" is explained. First, any point on the first body element 101*a* and any point on the second body element in the longitudinal direction are prescribed. A distance between the prescribed points of the first and second body elements 101*a*, 101*b* is defined as a first position defining distance. Next, when the first and second body elements 101*a*, 101*b* are moved with respect to each other, the distance between the prescribed points of the first and second body elements 101*a*, 101*b* is defined as a second position defining distance. Here, the first position defining distance is assumed to be longer than the second position defining distance. In this case, the first and second body elements 101*a*, 101*b* are "away from each other" when forming the first position defining distance, while the first and second body elements 101*a*, 101*b* are "close to each other" when forming the second position defining distance.

The first and second body elements 101*a*, 101*b* are connected to each other by a biasing member 181. The biasing member 181 biases the first and second body elements 101*a*, 101*b*, so that the first and second body elements 101*a*, 101*b* reciprocate with respect to each other.

The biasing member 181 is formed by a member having spring elasticity. An example of the biasing member 181 is a coil spring. When using a coil spring as the biasing member 181, one end of the coil spring is fixed to the first body element 101*a* and the other end is fixed to the second body element 101, so that the coil spring can bias the first and second body elements 101*a*, 101*b*. The biasing member 181 is preferably configured to bias the first and second body elements 101*a*, 101*b* in a direction away from each other. With such a structure, when the first and second body elements 101*a*, 101*b* move toward each other, outer shells of the first and second body elements 101*a*, 101*b* are prevented from colliding with each other.

When the direction in which the biasing member 181 biases the first and second body elements 101*a*, 101*b* coincides with the striking axis, vibration which is caused by driving of the striking mechanism 140 can be effectively reduced. Specifically, with such a structure, the biasing member 181 easily receives vibration which is caused in the direction of the striking axis by driving of the striking mechanism 140, so that more efficient movement of the first and second body elements 101*a*, 101*b* with respect to each other can be promoted. The biasing direction of the biasing member 181 can be made to coincide with the striking axis typically by disposing the biasing member 181 coaxially with the central striking axis 140*a*. As shown in FIG. 1, however, even in a structure in which the biasing member 181 is not disposed coaxially with the central striking axis 140*a*, a prescribed effect can be obtained if part of the biasing member 181 is disposed on the striking axis.

Further, the biasing member 181 may be arranged such that its axis extends in parallel to the striking axis, or its axis extends in a direction crossing the striking axis, or the biasing member 181 may be curved to be coaxially arranged or overlapped with the striking axis.

The long-distance moving region 200 and the short-distance moving region 210 may be formed, for example, by providing the biasing member 181 in both the first region 100*a* and the second region 100*b* and setting a biasing force of the biasing member 181 of the first region 100*a* to be weaker than that of the biasing member 181 of the second region 100*b*.

Further, the long-distance moving region 200 and the short-distance moving region 210 may be formed such that the first and second body elements 101*a*, 101*b* rotate around a rotation axis 182 with respect to each other. In this case, the rotation axis 182 is provided closer to the second region 100*b* than to the first region 100*a*. Further, the rotation axis 182 can be provided closer to the center of gravity 100*c* of the impact tool 100 with the battery 161 mounted on the battery mounting part 160, than to the striking axis. The state in which the rotation axis 182 is closer to the center of gravity 100*c* than to the striking axis means that, for example, when a virtual line perpendicular to the striking axis and passing through the center of gravity 100*c* and an intersection point of this virtual line and the striking axis are defined, the distance between the rotation axis 182 and the center of gravity 100*c* is shorter than the distance between the rotation axis 182 and the above-described intersection point.

The vibration-proofing mechanism 180 forms a restricting part 190 for restricting movement of the first and second body elements 101*a*, 101*b* in a direction away from or toward each other. The restricting part 190 can prevent the first and second body elements 101*a*, 101*b* from falling off by restricting the movement of the first and second body elements 101*a*, 101*b* in the direction away from each other. Further, the restricting part 190 can prevent the rear edge 101*aa* of the first body element 101*a* and the stepped part 101*bc* of the second body element 101*b* from colliding with each other by restricting the movement of the first and second body elements 101*a*, 101*b* in the direction toward each other. Specifically, the restricting part 190 can prevent the body 101 from being damaged by collision between the first and second body elements 101*a*, 101*b*. In this sense, it can be said that the restricting part 190 forms a collision preventing mechanism for preventing collision between the first and second exposed regions 101*a*2, 101*b*2.

The restricting part 190 is preferably disposed above the striking axis. With this structure, it is made easier to set the distance of movement of the first and second body elements 101*a*, 101*b* in a direction away from each other in the long-distance moving region 200.

With the above-described structure, when vibration is caused by driving of the striking mechanism 140, the first and second body elements 101*a*, 101*b* reciprocate with respect to each other, so that transmission of vibration to the user's hand is reduced. Further, instead of saying that the first and second body elements 101*a*, 101*b* reciprocate with respect to each other, it can also be said that a group having the striking mechanism 140 and the driving motor 110 and a group having the handle 109 and the battery mounting part 160 reciprocate with respect to each other.

In order to cool the driving motor 110, the driving motor 110 may be provided with a motor intake port 303 and a motor exhaust port 304. In this case, the body 101 is provided with a body intake port 301 and a body exhaust port 302. The body intake port 301 is provided in a region of the second covered region 101*b*1 which is closer to the motor intake port 303 than to the motor exhaust port 304. Further, the body exhaust port 302 is provided in a region of the second covered region 101*b*1 which is closer to the motor exhaust port 304 than to the motor intake port 303.

In the impact tool 100 according to the present invention, the first body element 101*a* and the second body element 101*b* are moved with respect to each other while forming the long-distance moving region 200 and the short-distance moving region 210. Therefore, particularly in a region surrounding the driving motor 110, a rotation allowable space 320 is formed as a space for allowing the driving motor 110 to relatively move within the second body element 101*b*. Depending on the structure of the rotation allowable space 320, air discharged from the motor exhaust port 304 may be returned (circulated) to the motor intake port 303 without being discharged from the body exhaust port 302. If such air circulation occurs, it is hard to effectively cool the driving motor 110. In the present invention, in order to prevent such an occurrence, an air circulation preventing mechanism 300 may be provided between the motor intake port 303 and the motor exhaust port 304.

An example of the air circulation preventing mechanism 300 is a wall-like member 310 which can be disposed inside the body 101 and extend in a prescribed direction. The wall-like member 310 can be provided in one of the first body element 101*a* and the second body element 101*b*. In FIG. 1, an example structure of the wall-like member 310 is shown which is formed by providing a flange on part of the motor case 110*a* (the first body element 101*a*). A prescribed gap is formed as the rotation allowable space 320 between a distal end of the wall-like member 310 and an inner wall of the second body element 101*b*. With such a structure, the distal end of the wall-like member 310 and the inner wall of the second exposed region 101*b*2 can be prevented from colliding with each other by movement of the first and second body elements 101*a*, 101*b* with respect to each other. In this sense, it can be said that the gap between the wall-like member 310 and the second body element 101*b* forms a collision avoidance gap. Further, when the wall-like member 310 is provided in the second body element 101*b*, the collision avoidance gap is formed between the distal end of the wall-like member 310 and the first covered region 101*a*1 (the motor case 110*a*).

With such a structure, the wall-like member 310 blocks flow of discharged air from the motor exhaust port 304 to the motor intake port 303. Therefore, the air discharged from the motor exhaust port 304 is discharged to the outside of the body 101 through the body exhaust port 302. Specifically, the wall-like member 310 prevents air circulation from the motor exhaust port 304 to the motor intake port 303.

Further, in FIG. 1, the wall-like member 310 having a single structure is shown, but a plurality of the wall-like members 310 may be provided.

Second Embodiment of the Invention

A second embodiment of the present invention is now explained with reference to FIGS. 2 to 8. The second embodiment is different from the first embodiment in that the first and second body elements 101*a*, 101*b* rotate with respect to each other.

Figure 2:
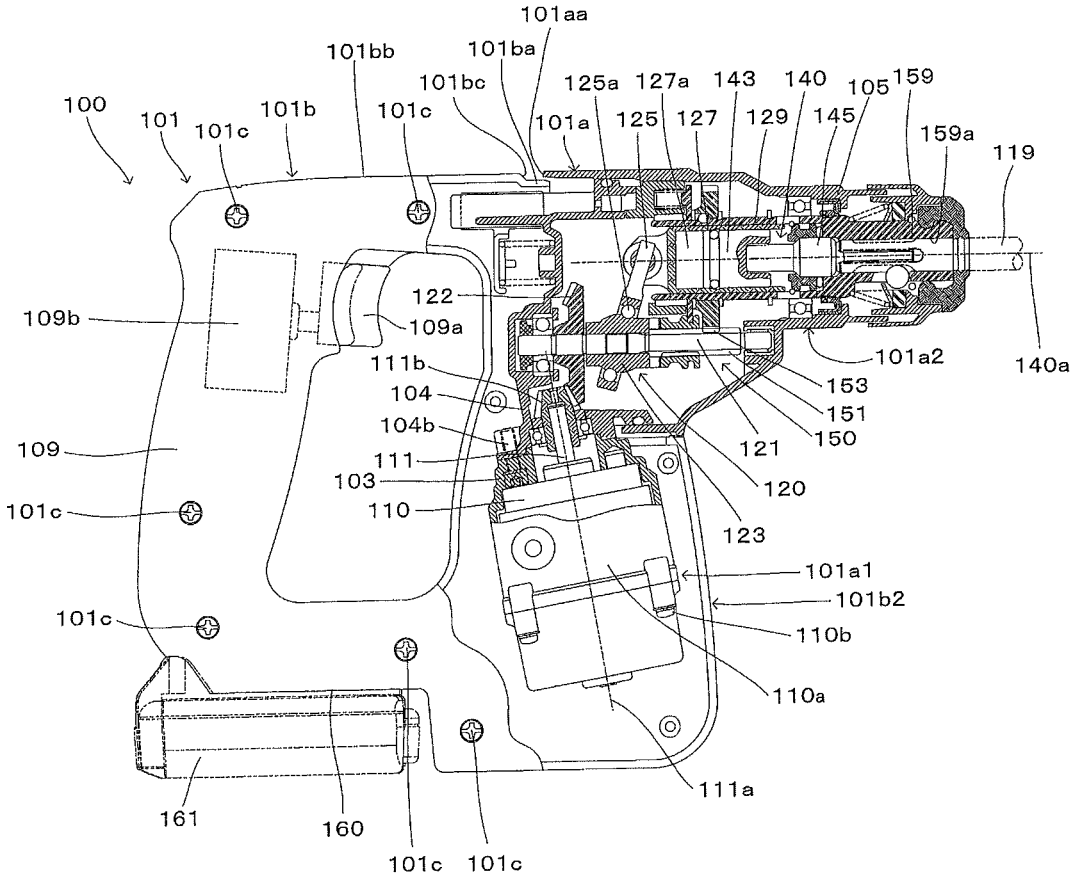
FIG. 2 is a sectional view showing a driving mechanism of a tool accessory in an impact tool according to a second embodiment of the present invention.

In the second embodiment of the present invention, a battery-powered hammer drill 100 is described as a representative example of the impact tool. FIG. 2 is a sectional view for illustrating a mechanism relating to hammering motion and rotating motion of the hammer drill 100. As shown in FIG. 2, the hammer drill 100 is a hand-held impact tool having a handgrip 109 designed to be held by a user, and configured to perform hammering motion for a hammering operation such as a chipping operation on a workpiece by driving a hammer bit 119 in its axial direction, or to perform rotating motion for a drilling operation on a workpiece by rotationally driving the hammer bit 119 around its axis. The longitudinal direction in which the hammer drill 100 drives the hammer bit 119 defines the longitudinal direction of the hammer drill 100. This longitudinal direction coincides with the axial direction of the hammer bit 119 coupled to the hammer drill 100. Further, a trigger 109*a* which is operated by the user is disposed on the front side of the handgrip 109. The hammer drill 100, the hammer bit 119 and the handgrip 109 are example embodiments that correspond to the "impact tool", the "tool accessory" and the "handle", respectively, according to the present invention.

(Structure of the Body)

As shown in FIG. 2, the hammer drill 100 mainly includes the body 101 that forms an outer shell of the hammer drill 100. The hammer bit 119 is detachably mounted to the front end region of the body 101 via a cylindrical tool holder 159. The hammer bit 119 is inserted into a bit insertion hole 159*a* of the tool holder 159 and held such that it is allowed to reciprocate in its longitudinal direction with respect to the tool holder 159 and prevented from rotating in its circumferential direction with respect to the tool holder 159. The tool holder 159 is an example embodiment that corresponds to the "tool accessory mounting part" according to the present invention.

As shown in FIG. 2, the body 101 includes the first body element 101*a* and the second body element 101*b*. The first body element 101*a* and the second body element 101*b* are example embodiments that correspond to the "first body element" and the "second body element", respectively, according to the present invention.

The first body element 101*a* mainly includes a motor housing 103 that houses an electric motor 110, a gear housing 105 that houses a motion converting mechanism 120, the striking mechanism 140 and a rotating power transmitting mechanism 150, and an inner housing 104 that is fixed to both the motor housing 103 and the gear housing 105. Further, the electric motor 110 is housed in the motor case 110*a* and fixed to the motor housing 103. The motor housing 103 and the inner housing 104 are fixed by a fastening member 104*b* such as a screw. Thus, the electric motor 110 and the first body element 101*a* are integrated with each other. Further, the motor case 110*a* is formed by an upper member and a lower member. The electric motor 110 is surrounded by the upper and lower members and then the upper and lower members are fixed by a fastening member 110*b* such as a screw. The electric motor 110 and the motor case 110*a* are example embodiments that correspond to the "driving motor" and the "motor holding part", respectively, according to the present invention. Further, the tool holder 159 is mounted to the first body element 101*a*.

The second body element 101*b* mainly includes the handgrip 109 and the battery mounting part 160 for mounting the battery 161 which serves to supply current to the electric motor 110. The battery mounting part 160 has a groove extending in the longitudinal direction and a terminal for electric connection with a terminal of the battery 161. The battery 161 has a guide rail for engagement with the groove of the battery mounting part 160 and the battery-side terminal for connection with the terminal of the battery mounting part 160. The battery 161 and the battery mounting part 160 are example embodiments that correspond to the "battery" and the "battery mounting part", respectively, according to the present invention.

Figure 3:
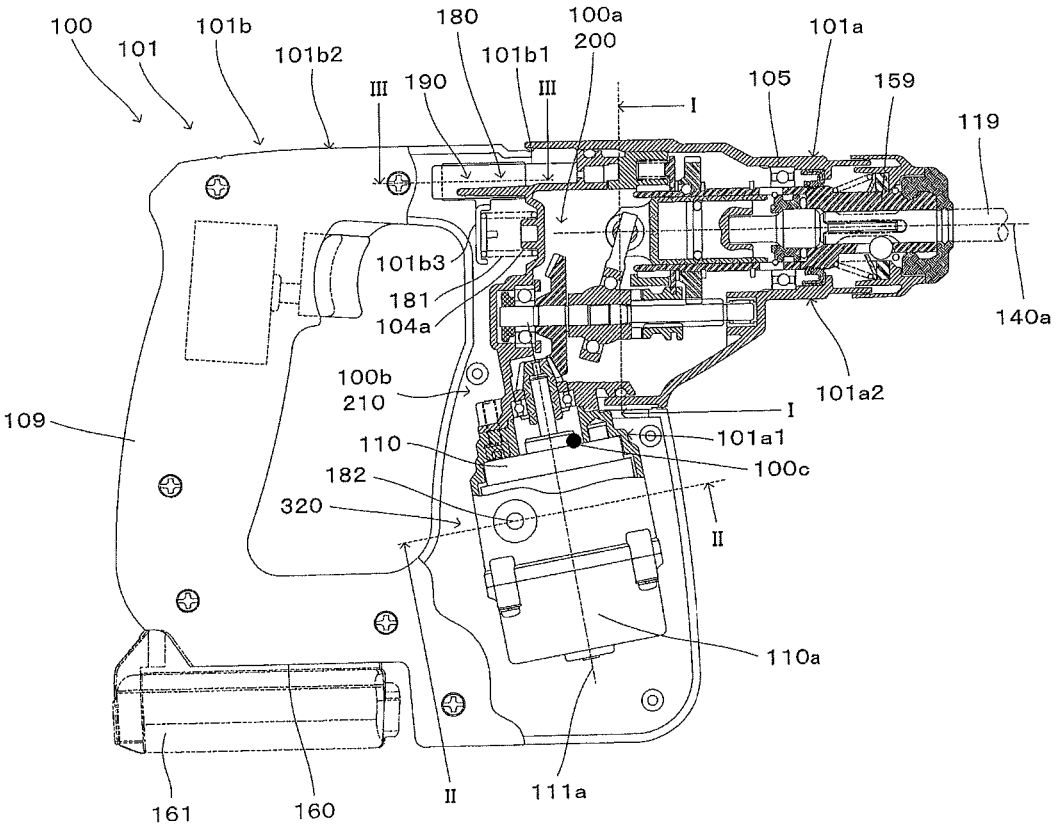
FIG. 3 is a sectional view showing a vibration-proofing mechanism in the impact tool.
Figure 4:
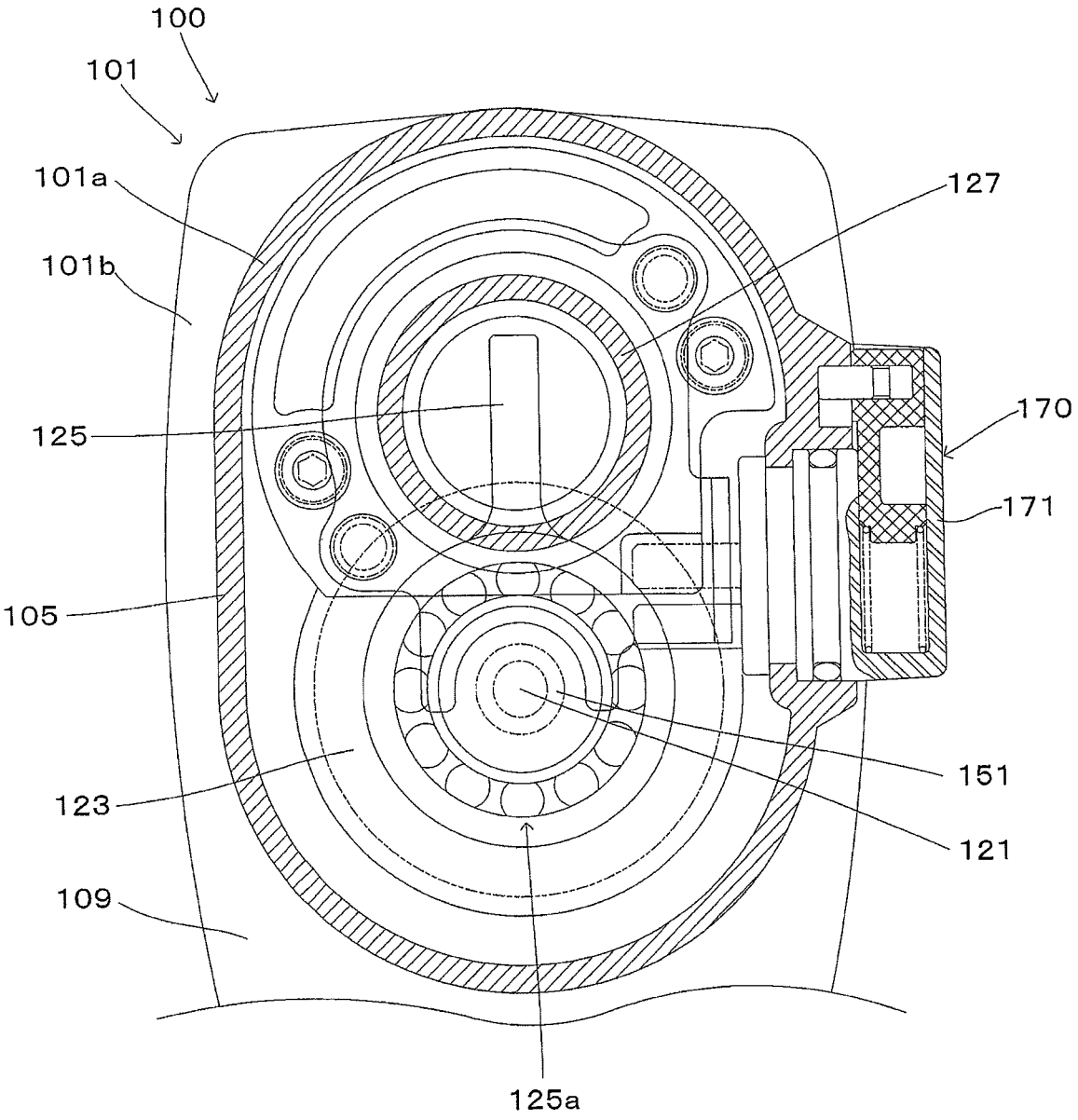
FIG. 4 is a sectional view taken along line I-I in FIG. 3.

In the second embodiment, like in the first embodiment shown in FIG. 1, in the longitudinal direction, a front side of the tool holder 159 is defined as a front side and the handgrip 109 side opposite to the front side is defined as a rear side. Further, in a direction crossing the longitudinal direction, the tool holder 159 side is defined as an upper side and the battery mounting part 160 side is defined as a lower side. In this definition, the right, left, upper and lower sides in FIGS. 2, 3 and 7 correspond to front, rear, upper and lower sides in the hammer drill 100, respectively. Further, FIG. 4 is a sectional view taken along line I-I in FIG. 3 and the right and left sides in FIG. 4 correspond to the right and left sides in the hammer drill 100, respectively. In this sense, it can be said that FIGS. 2, 3 and 7 are sectional right-side views of the hammer drill 100.

As shown in FIG. 2, in the axial direction of the hammer bit 119, the first body element 101*a* has the gear housing 105 in the front, the inner housing 104 in the rear and the motor housing 103 in the lower side. Thus, the electric motor 110 is disposed in the first covered region 101*a*1. The electric motor 110 is arranged such that an output axis 111*a* of the shaft 111 of the electric motor 110 extends in a direction crossing the longitudinal direction of the hammer drill 100. The first exposed region 101*a*2, the first covered region 101*a*1 and the output axis 111 are example embodiments that correspond to the "exposed region", the "first covered region" and the "output axis", respectively, according to the present invention.

The second body element 101*b* has the handgrip 109 in the rear. Further, the second body element 101*b* has the open front end region 101*ba* on the front, and the stepped part 101*bc* is formed in the boundary between the open front end region 101*ba* and the main region 101*bb*. A front region of the open front end region 101*ba* forms the second covered region 101*b*1. The second covered region 101*b*1 is an example embodiment that corresponds to the "second covered region" according to the present invention. The handgrip 109 is formed in the main region 101*bb* of the second exposed region 101*b*2.

Further, the second body element 101*b* is formed by connecting right and left halves of the second body element 101*b* along the axial direction of the hammer bit 119 by a fastening member 101*c* such as a screw.

(Structure for Hammering and Rotating Operations)

As shown in FIG. 2, the rotating output of the electric motor 110 is appropriately converted into linear motion by the motion converting mechanism 120 and then transmitted to the striking mechanism 140. As a result, an impact force is generated in the axial direction of the hammer bit 119 (a horizontal direction in FIG. 1) via the striking mechanism 140. The striking mechanism 140 is an example embodiment that corresponds to the "striking element" according to the present invention. Further, the speed of the rotating output of the electric motor 110 is appropriately reduced by the rotating power transmitting mechanism 150 and then transmitted to the hammer bit 119. As a result, the hammer bit 119 is rotated in the circumferential direction. The electric motor 110 is energized by a switch which is actuated by depressing the trigger 109*a* on the handgrip 109.

As shown in FIG. 2, the motion converting mechanism 120 is disposed above the shaft 111 of the electric motor 110 and serves to convert the rotating output of the shaft 111 into linear motion in the longitudinal direction of the hammer drill 100. The motion converting mechanism 120 mainly includes an intermediate shaft 121 that is rotationally driven by a bevel gear 122 which engages with a pinion gear 111*b* of the shaft 111, a rotating element 123 fitted onto the intermediate shaft 121, a swinging member 125 that is caused to swing in the front-back direction of the hammer drill 100 by rotation of the intermediate shaft 121 (the rotating element 123), a driving element in the form of a cylindrical piston 127 that is caused to reciprocate in the front-back direction of the hammer drill 100 by swinging motion of the swinging member 125, and a cylinder 129 that houses the piston 127. The cylinder 129 is disposed behind the tool holder 159 and integrally formed with the tool holder 159. Further, the swinging member 125 is mounted to the rotating element 123 via a bearing 125*a*.

As shown in FIG. 2, the striking element 140 is disposed above the motion converting mechanism 120 and behind the tool holder 159, and serves to transmit linear motion in the front-back direction of the hammer drill 100, into which rotation of the electric motor 110 is converted by the motion converting mechanism 120, to the hammer bit 119 as a striking force. The striking mechanism 140 mainly includes a striking element in the form of a striker 143 which is slidably disposed within the cylindrical piston 127, and an intermediate element in the form of an impact bolt 145 which is disposed in front of the striker 143 and with which the striker 143 collides. Further, a space behind the striker 143 within the piston 127 forms an air chamber 127*a* which serves to transmit sliding motion of the piston 127 to the striker 143 via fluctuations of air pressure.

As shown in FIG. 2, the rotating power transmitting mechanism 150 is disposed in front of the motion converting mechanism 120 and serves to transmit the rotating output of the electric motor 110 from the intermediate shaft 121 of the motion converting mechanism 120 to the tool holder 159. The rotating power transmitting mechanism 150 mainly includes a gear speed reducing mechanism having a plurality of gears, such as a first gear 151 which rotates together with the intermediate shaft 121 and a second gear 153 which is engaged with the first gear 151 and fitted onto the tool holder 159 (the cylinder 129).

FIG. 3 is a sectional view for illustrating the vibration-proofing mechanism 180 which is described below. FIG. 4 is a sectional view taken along line I-I in FIG. 3 and specifically facing the handgrip 109 side. Further, for convenience to clarify relations among parts, a section of the piston 127 is shown in FIG. 4.

As shown in FIG. 4, a switching mechanism 170 for switching a drive mode of the hammer drill 100 is provided in the first body element 101*a*. The switching mechanism 170 has an operation dial 171 designed to be operated by a user. The drive mode of the hammer drill 100 is appropriately selected by switching the operation dial 171 among a hammer mode in which the hammer bit 119 performs hammering motion, a drill mode in which the hammer bit 119 performs rotating motion and a hammer drill mode in which the hammer bit 119 performs both the linear motion and the rotating motion. Further, the structure of the switching mechanism 170 and the operations of the motion converting mechanism 120 and the rotating power transmitting mechanism 150 associated with switching of the switching mechanism 170 are not expediently described.

(Structure of the Vibration-Proofing Mechanism)

The vibration-proofing mechanism 180 is explained with reference to FIGS. 3 and 5 to 8. As shown in FIG. 3, the vibration-proofing mechanism 180 has the biasing member 181 that biases the first and second body elements 101*a*, 101*b* in a direction away from each other, the rotation axis 182 around which the first and second body elements 101*a*, 101*b* rotate with respect to each other, and the restricting part 190 that restricts movement of the first and second body elements 101*a*, 101*b* in a direction away from or toward each other. The vibration-proofing mechanism 180, the biasing member 181, the rotation axis 182 and the restricting part 190 are example embodiments that correspond to the "vibration-proofing mechanism", the "biasing member", the "rotation axis" and the "restricting part", respectively, according to the present invention.

As shown in FIG. 3, the biasing member 181 is formed by a coil spring. One end of the biasing member 181 is fixed to the first body element 101*a* and the other end is fixed to the second body element 101*b*. Specifically, one end of the biasing member 181 is fixed to a biasing member support part 104*a* which is provided in a region of the inner housing 104 behind the gear housing 105, and the other end is fixed to a support plate 101*b*3 mounted to the second body element 101*b*. At this time, the central axis of the biasing member 181 is coaxial with the central striking axis 140*a*.

As shown in FIG. 3, the rotation axis 182 is arranged closer to the center of gravity 100*c* of the hammer drill 100 than to the central striking axis 140*a*. Further, the center of gravity 100*c* is defined as a center of gravity of the hammer drill 100 with the battery 161 mounted on the battery mounting part 160. The center of gravity 100*c* is an example embodiment that corresponds to the "center of gravity" according to the present invention.

Figure 5:
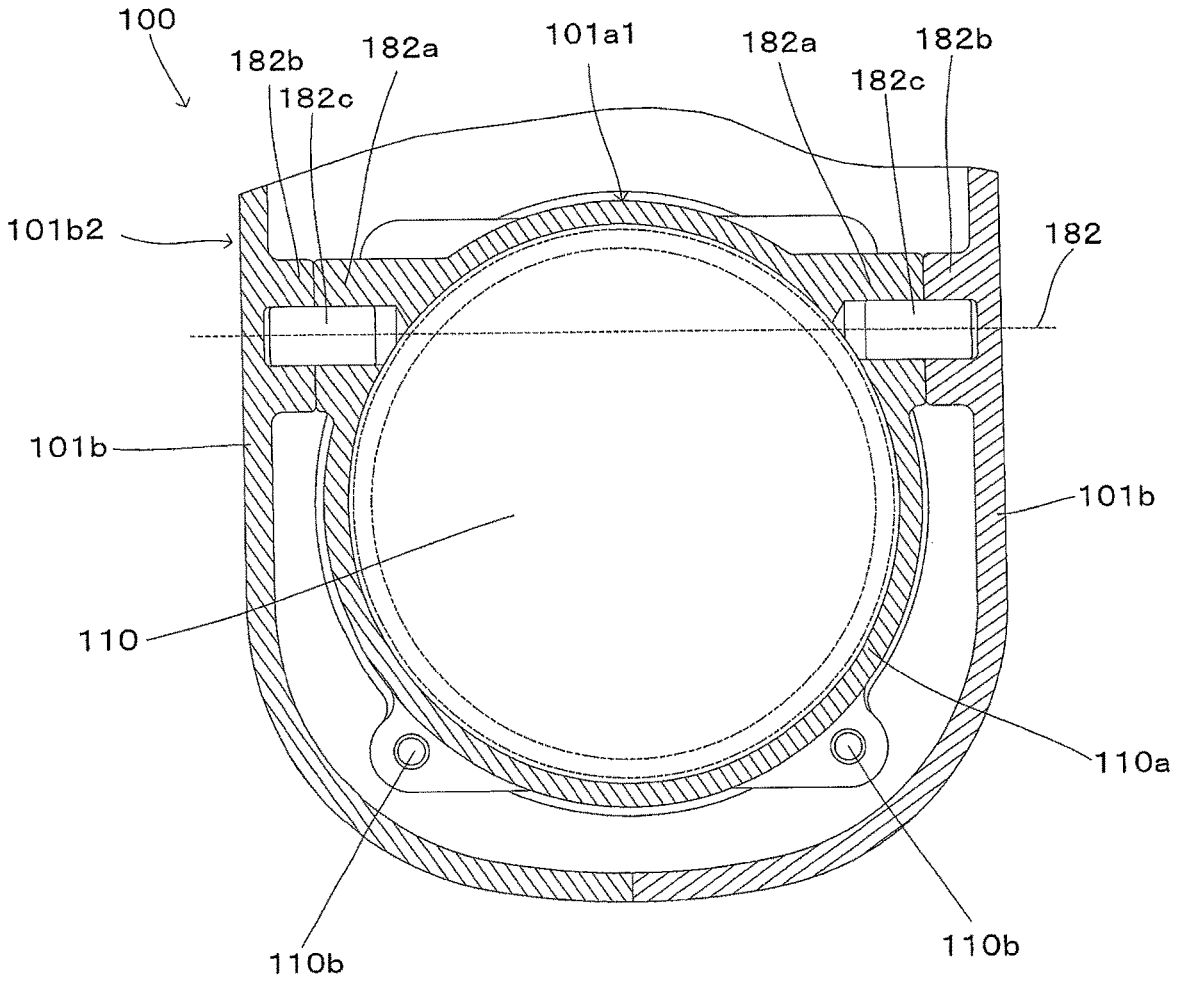
FIG. 5 is a sectional view taken along line II-II in FIG. 3.

A detailed structure of the rotation axis 182 is explained with reference to FIG. 5. FIG. 5 is a sectional view taken along line II-II in FIG. 3. As shown in FIG. 5, the rotation axis 182 extends in a transverse direction perpendicular to the longitudinal direction of the hammer drill 100. The rotation axis 182 is defined by a first pivot support part 182*a* that protrudes outward from the motor case 110*a* and has a recess, a second pivot support part 182*b* that protrudes inward from the second body element 101*b* and has a recess, and a pivot member 182*c* fitted in both the recesses of the first and second pivot support parts 182*a*, 182*b*. Specifically, the rotation axis 182 is a straight line extending through the pivot member 182*c* in its longitudinal direction. Further, a distal end of a protruding part of the first pivot support part 182*a* and a distal end of a protruding part of the second pivot support part 182*b* are held in contact with each other. With the structure in which the first pivot support part 182*a* is provided in the motor case 110*a*, it can be said that the pivot member 182*c* is formed in the motor case 110*a*. The pivot member 182*c* is an example embodiment that corresponds to the "pivot member" according to the present invention.

The restricting part 190 shown in FIG. 3 restricts movement of the first and second body elements 101*a*, 101*b* in a direction toward or away from each other. The restricting part 190 is disposed above the central striking axis 140*a*. Specifically, the restricting part 190 is arranged at a position distant from the rotation axis 182. With this structure, the length of the restricting part 190 in the longitudinal direction can be increased. Therefore, the distance of movement of the first and second body elements 101*a*, 101*b* with respect to each other can be secured without increasing structural accuracy of the restricting part 190 itself.

Figure 6:
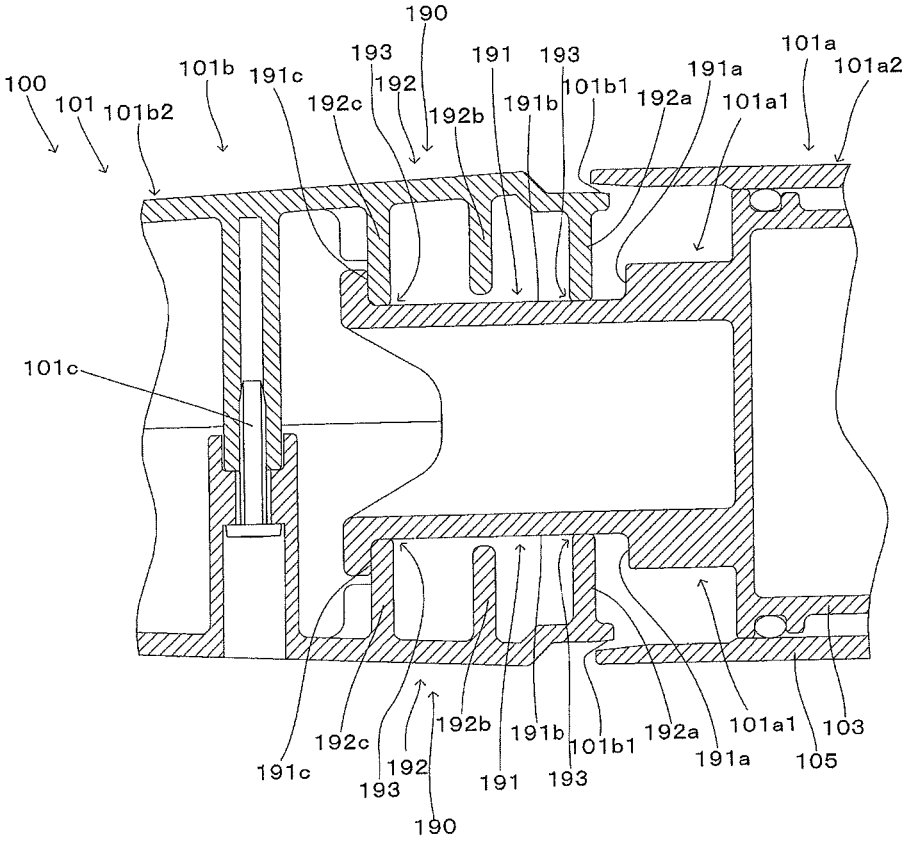
FIG. 6 is a sectional view taken along line III-III in FIG. 3.

A specific structure of the restricting part 190 is explained with reference to FIG. 6. FIG. 6 is a sectional view taken along line III-III in FIG. 3. The restricting part 190 is formed in prescribed regions of the first and second body elements 101*a*, 101*b* which overlap each other. As for the prescribed regions in which the restricting part 190 is formed, the prescribed region of the first body element 101*a* is defined as a first restricting region 191 and the prescribed region of the second body element 101*b* is defined as a second restricting region 192. In the second embodiment, the first restricting region 191 is formed on the outside of the first covered region 101*a*1 and the second restricting region 192 is formed on the inside of the second exposed region 101*b*2.

As shown in FIG. 6, the first restricting region 191 is formed on the first body element 101*a* (the first covered region 101*a*1) extending in the longitudinal direction within the second body element 101*b*. The first restricting region 191 has a front wall 191*a*, a rear wall 191*c* and an extending part 191*b* which extends in the longitudinal direction between the front wall 191*a* and the rear wall 191*c*. The front wall 191*a*, the extending part 191*b* and the rear wall 191*c* are formed to face the outside of the hammer drill 100.

The second restricting region 192 is formed on the second exposed region 101*b*2 covering the first restricting region 191 and has a front rib 192*a*, a rear rib 192*c* and an intermediate rib 192*b* formed between the front rib 192*a* and the rear rib 192*c*. The front rib 192*a*, the intermediate rib 192*b* and the rear rib 192*c* are formed to face the inside of the hammer drill 100.

The front rib 192*a* and the rear rib 192*c* are configured such that their distal ends are held in contact with the extending part 191*b*. With such a structure, as described below, the front rib 192*a*, the rear rib 192*c* and the extending part 191*b* form a sliding guide 193 for guiding the movement of the first body element 101*a* and the second body element 101*b* with respect to each other. The sliding guide 193 is an example embodiment that corresponds to the "guide" according to the present invention. Further, the intermediate rib 192*b* has a function of securing the strength of the second restricting region 192. Specifically, it can be said that the second restricting region 192 has a strength retaining element.

(Operation of the Hammer Drill)

An operation of the hammer drill 100 according to the second embodiment is now explained with reference to FIGS. 3, 6 to 8. FIGS. 3 and 6 show a state in which the first and second body elements 101*a*, 101*b* are rotated around the rotation axis 182 in a direction away from each other by the biasing force of the biasing member 181. FIG. 7 shows a state in which the first and second body elements 101*a*, 101*b* are rotated around the rotation axis 182 in a direction toward each other against the biasing force of the biasing member 181. Further, FIG. 8 is a sectional view taken along line IV-IV in FIG. 7.

The vibration-proofing mechanism 180 causes the first and second body elements 101*a*, 101*b* to rotate around the rotation axis 182 with respect to each other between the states shown in FIGS. 3 and 7 when vibration is caused by driving of the striking mechanism 140 in the hammer mode or hammer drill mode.

The hammer drill 100 has the first region 100*a* close to the striking mechanism 140 and the second region 100*b* less close to the striking mechanism 140 than the first region 100*a*. The first region 100*a* and the second region 100*b* are example embodiments that correspond to the "first region" and the "second region", respectively, according to the present invention. The first and second body elements 101*a*, 101*b* move a longer distance in the longitudinal direction in the first region 100*a* than in the second region 100*b* when the first and second body elements 101*a*, 101*b* rotate around the rotation axis 182 with respect to each other. Specifically, the first region 100*a* and the second region 100*b* form the long-distance moving region 200 and the short-distance moving region 210, respectively. The long-distance moving region 200 is an example embodiment that corresponds to the "long-distance moving region" according to the present invention.

In the hammer drill 100, with the structure in which the first region 100*a* close to the striking mechanism 140 forms the long-distance moving region, vibration which is caused by driving of the striking mechanism 140 can be effectively reduced. Particularly, the central axis of the biasing member 180 is coaxial with the central striking axis 140*a*, so that the biasing member 180 can efficiently receive vibration of the striking mechanism 140.

In the restricting part 190, as shown in FIG. 6, when the first and second body elements 101*a*, 101*b* move away from each other, the rear rib 192*c* comes in contact with the rear wall 191*c*. Thus, the first and second body elements 101*a*, 101*b* can be prevented from further moving away from each other.

On the other hand, as shown in FIG. 8, when the first and second body elements 101*a*, 101*b* move toward each other, the front rib 192*a* comes in contact with the front wall 191*a*. Thus, the first and second body elements 101*a*, 101*b* can be prevented from further moving toward each other. Particularly, the rear edge 101*aa* of the first body element 101*a* and the stepped part 101*bc* of the second body element 101*b* which are shown in FIG. 2 can be prevented from coming in contact with each other.

In the restricting part 190, the sliding guide 193 is formed by contact between the extending part 191*b* and the front and rear ribs 192*a*, 192*c*. When the first and second body elements 101*a*, 101*b* rotate around the rotation axis 182, the sliding guide 193 can prevent the first and second body elements 101*a*, 101*b* from moving with respect to each other in the transverse direction crossing the longitudinal direction.

Specifically, it can be said that the restricting part 190 is configured to restrict the distances of movement of the first and second body elements 101*a*, 101*b* in their rotating direction and in the extending direction of the rotation axis 182.

The extending part 191*b* is configured to be flat and smooth so as not to obstruct movement of the front rib 192*a* and the rear rib 192*c* in a region of the extending part 191*b* on which the front rib 192*a* and the rear rib 192*c* move. In this sense, it can be said that the extending part 191*b* has a smooth region and the front and rear ribs 192*a*, 192*c* are configured to be slidable on the smooth region. Further, the smooth region means that it is free of obstacles which obstruct sliding movement of the front and rear ribs 192*a*, 192*c*. In this sense, the smooth region can be referred to as an obstacle-free region.

Based on the above-described operation, in the hammer drill 100, vibration caused by driving of the striking mechanism 140 can be effectively reduced.

Third Embodiment of the Invention

A third embodiment of the present invention is explained below with reference to FIGS. 9 to 11.

The hammer drill 100 of the third embodiment is different from the hammer drill 100 of the second embodiment in that it has an air circulation preventing mechanism 300. The air circulation preventing mechanism 300 is an example embodiment that corresponds to the "air circulation preventing mechanism" according to the present invention.

As shown in FIG. 9, the second body element 101*b* of the hammer drill 100 according to the third embodiment has the body intake port 301 for taking in outside air and the body exhaust port 302 for discharging air from inside the body 101. The driving motor 110 is disposed in the first covered region 101*a*1 between the body intake port 301 and the body exhaust port 302 inside the body 101. With this structure, air taken in through the body intake port 301 passes through the driving motor 110 before being discharged from the body exhaust port 302, so that the driving motor 110 can be cooled.

As shown in FIG. 10, the motor intake port 303 is provided in a top of the driving motor 110. A motor case intake port 306 is provided in a region of the motor case 110*a* which corresponds to the motor intake port 303. Further, a fan 305 is mounted on the shaft 111 inside the driving motor 110 and rotationally driven by the shaft 111. The motor exhaust port 304 is provided in a region of the outer shell of the driving motor 110 which corresponds to the fan 305, and a motor case exhaust port 307 is provided in a region of the motor case 110*a* which corresponds to the motor exhaust port 304. The motor intake port 303 and the motor exhaust port 304 are example embodiments that correspond to the "intake port" and the "exhaust port", respectively, according to the present invention.

With such a structure, air taken in from the body intake port 301 is sucked into the driving motor 110 through the motor case intake port 306 and the motor intake port 303 by rotation of the fan 305. The air within the driving motor 110 is then discharged from the body exhaust port 302 through the motor exhaust port 304 and the motor case exhaust port 307 by rotation of the fan 305. Thus, the effect of cooling the driving motor 110 can be enhanced by passing air through the driving motor 110.

Further, as shown in FIG. 11, in the hammer drill 100 according to the third embodiment, the wall-like member 310 is provided as the air circulation preventing mechanism 300. The wall-like member 310 is an example embodiment that corresponds to the "wall-like member" according to the present invention. The wall-like member 310 is formed by a rib that protrudes inward from the inner wall of the second exposed region 101*b*2 which covers the driving motor 110. The wall-like member 310 is configured to surround the driving motor 110, and a prescribed gap is formed between the distal end (inner peripheral edge) of the wall-like member 310 and the driving motor 110 as the collision avoidance gap as explained with reference to FIG. 1. By providing this gap, even when the first and second body elements 101*a*, 101*b* move with respect to each other, the wall-like member 310 and the driving motor 110 can be avoided from colliding with each other.

As shown in FIG. 11, the wall-like member 310 includes a first wall-like member 311 and a second wall-like member 312. An extension plane 311*a* of the first wall-like member 311 is placed on the motor intake port 303 (the motor case intake port 306) when the first and second body elements 101*a*, 101*b* are moved away from each other. Further, the rotation axis 182 is located on an extension plane 312*a* of the second wall-like member 312. Here, an extension plane of the wall-like member 310 is explained. The wall-like member 310 has surfaces opposed to each other and an intermediate part located between the opposed surfaces. Assuming that the wall-like member 310 is extended, the extension plane of the wall-like member 310 is defined as a plane which is parallel to the extending direction of the wall-like member 310 and passes through any one of the opposed surfaces and the intermediate part of the wall-like member 310.

Further, when the first and second body elements 101*a*, 101*b* are not rotated, the output axis 111*a* of the driving motor 110 is configured to be perpendicular to the extension plane 312*a* of the second wall-like member 312. Specifically, the extension plane 312*a* of the second wall-like member 312 is located on the rotation axis 182 and perpendicular to the output axis 111*a* of the driving motor 110.

Alternatively, it may also be configured such that the output axis 111*a* of the driving motor 110 is perpendicular to the extension plane 312*a* of the second wall-like member 312 when the rotating first and second body elements 101*a*, 101*b* come closest to each other.

In the hammer drill 100 according to the third embodiment, the second wall-like member 312 is not formed in a region located on the rotation axis 182. Specifically, in the region located on the rotation axis 182, it is not necessary to provide the rotation allowable space 320, so that the second body element 101*b* and the driving motor 110 are disposed adjacent to each other. In this sense, it can be said that regions of the second body element 101*b* and the driving motor 110 which are located on the rotation axis 182 form the air circulation preventing mechanism 300.

In other words, the second wall-like member 312 is provided mainly in a region which is perpendicular to both the rotation axis 182 and the output axis 111*a* of the driving motor 110 and overlapped with the rotation axis 182. More specifically, the second wall-like member 312 includes a part extending between a region adjacent to the rear side of one of the second pivot support parts 182*b* (see FIG. 5) and a region adjacent to the rear side of the other second pivot support part 182*b*, and a part extending between a region adjacent to the front side of one of the second pivot support part 182*b* and a region adjacent to the front side of the other second pivot support part 182*b*. With this structure, both of the different functions of size reduction of the second body element 101*b* covering the driving motor 110 and cooling of the driving motor 110 can be achieved.

Further, the first wall-like member 311 is configured to surround the outer periphery of the driving motor 110. A prescribed gap (collision avoidance gap) is provided between the first wall-like member 311 and the driving motor 110.

With such a structure, like the hammer drill 100 according to the first and second embodiments, in the hammer drill 100 according to the third embodiment, the first and second body elements 101*a*, 101*b* are rotated around the rotation axis 182 with respect to each other. As a result, transmission of vibration to the user's hand can be reduced.

Further, the wall-like member 310 blocks air flow from the motor exhaust port 304 to the motor intake port 303, so that air discharged from the motor exhaust port 304 is efficiently discharged from the body exhaust port 302. Therefore, in the hammer drill 100 according to the third embodiment, the driving motor 110 can be cooled.

Fourth Embodiment of the Invention

A fourth embodiment of the present invention is now described with reference to FIGS. 12 to 14.

FIG. 12 is an external view of the hammer drill 100 of the fourth embodiment. As described above, the first and second body elements 101*a*, 101*b* form an overlapping region where they are overlaid one on the other. In the overlapping region, a covering side forms an exposed region (the first exposed region 101*a*2, the second exposed region 101*b*2) and a covered side forms a covered region (the first covered region 101*a*1, the second covered region 101*b*1). In this sense, it can be said that the overlapping region forms an overlap region 400 where the exposed region and the covered region overlap each other. The hammer drill 100 of the fourth embodiment has the overlap region 400 different in structure from the hammer drill 100 of the third embodiment. The overlap region 400 is an example embodiment that corresponds to the "overlap region" according to the present invention.

FIG. 13 is an explanatory drawing of the overlap region 400, showing part of a section taken along line V-V in FIG. 12. The second body element 101*b* has a flexible member 411. The flexible member 411 is covered by the first exposed region 101*a*2 and forms the second covered region 101*b*1. The flexible member 411 is an example embodiment that corresponds to the "flexible member" according to the present invention. The flexible member 411 is formed of elastomer and integrally formed with the second body element 101*b*.

More specifically, the second body element 101*b* has a flexible member arrangement region 410 having a front protruding part 410*a* and a rear protruding part 410*b* in its front end region. The flexible member 411 has a projection 411*a* disposed between the front protruding part 410*a* and the rear protruding part 410*b*, a recess 411*b* in which the front protruding part 410*a* is fitted, an extending part 411*c* extending forward from the recess 411*b* and a protrusion 411*d* formed on a front end of the extending portion 411*c* and configured to come in contact with an inner surface (facing the inside mechanisms) of the first exposed region 101*a*2.

When the hammer drill 100 is drivingly operated, the vibration-proofing mechanism 180 causes the first and second body elements 101*a*, 101*b* to reciprocate with respect to each other. In this state, the protrusion 411*d* of the flexible member 411 is held in sliding contact with the inner surface of the first exposed region 101*a*2. Specifically, the inner surface of the first exposed region 101*a*2 forms a sliding region 420. The sliding region 420 is an example embodiment that corresponds to the "sliding region" according to the present invention.

The flexible member 411 and the sliding region 420 forms the dust-proofing mechanism 430 by closing a gap formed between the first exposed region 101*a*2 and the second covered region 101*b*1. The dust-proofing mechanism 430 can prevent dust generated by operation of the hammer drill 100 from entering through the gap between the first exposed region 101*a*2 and the second covered region 101*b*1. Therefore, in the hammer drill 100 of the fourth embodiment, occurrence of trouble which may be caused by entry of dust into the body 101 can be reduced, and further the life of the hammer drill 100 can be extended.

Further, by providing the flexible member 411, the first and second body elements 101*a*, 101*b* can be easily assembled together.

As shown in FIG. 14, the second body element 101*b* has a two-split structure consisting of a right-side second body element 101*bd* and a left-side second body element 101*be*. Further, the first body element 101*a* has a cylindrical part 101*ac* with an opening 101*ab*. In the cylindrical part 101*ac*, the striking mechanism 140 and the rotating power transmitting mechanism 150 are disposed.

When assembling the first and second body elements 101*a*, 101*b* having the above-described structure, first, as shown in FIG. 14, the first body element 101*a* with the mechanisms assembled thereto and the left-side second body element 101*be* are assembled together. At this time, the flexible member 411 of the left-side second body element 101*be* is inserted into the cylindrical part 101*ac* through the opening 101*ab* of the first body element 101*a* and thus forms the second covered region 101*b*1. In this sense, it can be said that the flexible member 411 forms an insertion region 101*bf* which is inserted when assembled. After the first body element 101*a* and the left-side second body element 101*be* are assembled together, prescribed mechanisms are further mounted to the first body element 101*a* and the left-side second body element 101*be*.

Next, the right-side second body element 101*bd* is assembled to the first body element 101*a* and the left-side second body element 101*be*. First, the flexible member 411 (the insertion region 101*bf*) of the right-side second body element 101*bd* is inserted into the cylindrical part 101*ac* through the opening 101*ab* of the first body element 101*a*. At this time, the flexible member 411 can deform by contact with an opening edge (the rear edge 101*aa*) of the opening 101*ab*, so that the flexible member 411 can be inserted into the cylindrical part 101*ac*. When the front end of the flexible member 411 is inserted into the cylindrical part 101*ac*, the flexible member 411 can be further inserted into the inside of the cylindrical part 101*ac* while bending. In this state, the flexible member 411 serves to guide insertion of the right-side second body element 101*bd* into the first body element 101*a*, so that assembling operation can be easily performed.

As described above, in addition to the function of the hammer drill 100 of the third embodiment, the hammer drill 100 of the fourth embodiment has functions of dust-proofing and easy assembling by the flexible member 411.

Fifth Embodiment of the Invention

A fifth embodiment of the present invention is now explained with reference to FIG. 15.

FIG. 15 is an explanatory drawing of the overlap region 400 of the hammer drill 100 according to the fifth embodiment. As shown in FIG. 15, in the hammer drill 100 of the fifth embodiment, the flexible member 411 is provided on the first body element 101*a*. Specifically, the flexible member arrangement region 410 having the front protruding part 410*a* and the rear protruding part 410*b* is formed in the first body element 101*a*. Further, the sliding region 420 on which the protrusion 411*d* of the flexible member 411 slides is formed on an outer surface (on the side opposite to the inside mechanisms) of the second covered region 101*b*1 of the second body element 101*b*.

With this structure, like the hammer drill 100 of the fourth embodiment, the hammer drill 100 of the fifth embodiment also has the functions of dust-proofing and easy assembling by the flexible member 411.

Sixth Embodiment of the Invention

A sixth embodiment of the present invention is now explained with reference to FIG. 16.

FIG. 16 is an explanatory drawing showing an external appearance of the hammer drill 100 according to the sixth embodiment. In the hammer drill 100 of the sixth embodiment, a device is further added to the flexible member 411 of the hammer drill 100 of the fourth embodiment.

In the hammer drill 100 shown in FIG. 16, a bumper 101*d* is provided on the second body element 101*b*. User may put the hammer drill 100 on a table or floor. In this case, however, depending on the material or shape of the place to put, the second body element 101*b* may be damaged. In the hammer drill 100 of the sixth embodiment, the bumper 101*d* is formed on the exterior of the second body element 101*b*, so that damage to the hammer drill 100 when put on any place can be prevented.

The bumper 101*d* is formed of elastomer. In the hammer drill 100 of the sixth embodiment, the bumper 101*d* and the flexible member 411 are formed contiguously to each other. Therefore, the second body element 101*b* can be efficiently molded integrally with the flexible member 411 and the bumper 101*d*.

With this structure, like the hammer drill 100 of the fourth embodiment, the hammer drill 100 of the sixth embodiment also has the functions of dust-proofing and easy assembling by the flexible member 411. Moreover, by providing the bumper 101*d*, damage to the second body element 101*b* can be prevented. Further, the bumper 101*d*, the flexible member 411 and the second body element 101*b* can be integrally molded, so that increase in manufacturing cost can be prevented.

The hammer drill is explained as a representative example of the hammer drill 100 according to the present invention, but the present invention may be applied to a hammer which causes the hammer bit 119 to perform only hammering motion in the longitudinal direction, or to a cutting tool, such as a reciprocating saw and a jig saw, which causes a blade to perform reciprocating motion to cut a workpiece.

Further, in the above embodiment, the bumper 101*d* is described as an elastomer structure disposed in the body 101, but the elastomer structure is not limited to this. For example, it may include a slip stopper formed on the handgrip 109. The elastomer structure can be integrally molded on the body together with the flexible member 411. In this case, when the elastomer structure is formed contiguously to the structure of the flexible member 411, the integral molding can be more efficiently performed, so that increase in manufacturing cost can be prevented.

In view of the nature of the above-described invention, the hammer drill according to the present invention can be provided with the following features. Further, each of the features can be used separately or in combination with the other, or in combination with the claimed invention.

(Aspect 1)

The second region forms a short-distance moving region in which the first and second body elements move a shorter distance toward each other in the longitudinal direction than in the first region.

(Aspect 2)

The restricting part is disposed above the striking axis when the tool accessory mounting part side is defined as an upper side and the battery mounting part side is defined as a lower side in a direction crossing the longitudinal direction of the impact tool.

(Aspect 3)

A gap is formed between a distal end of the wall-like member and an inner wall of the body.

(Aspect 4)

The flexible member and the sliding region form a dust-proofing mechanism for preventing entry of dust through the overlap region.

(Aspect 5)

The flexible member forms a guide for guiding insertion of the second body element into the first body element.

Correspondences Between the Features of the Embodiments and the Features of the Invention The relationship between the features of the embodiments and the features of the invention and matters used to specify the invention are as follows. Naturally, each feature of the embodiments is only an example for embodiment relating to the corresponding matters to specify the invention, and each feature of the present invention is not limited to this.

The hammer drill 100 is an example embodiment that corresponds to the "impact tool" according to the present invention. The hammer bit 119 is an example embodiment that corresponds to the "tool accessory" according to the present invention. The handgrip 109 is an example embodiment that corresponds to the "handle" according to the present invention. The tool holder 159 is an example embodiment that corresponds to the "tool accessory mounting part" according to the present invention. The first body element 101*a* is an example embodiment that corresponds to the "first body element" according to the present invention. The second body element 101*b* is an example embodiment that corresponds to the "second body element" according to the present invention. The driving motor 110 is an example embodiment that corresponds to the "driving motor" according to the present invention. The motor case 110*a* is an example embodiment that corresponds to the "motor holding part" according to the present invention. The battery 161 is an example embodiment that corresponds to the "battery" according to the present invention. The battery mounting part 160 is an example embodiment that corresponds to the "battery mounting part" according to the present invention. The first exposed region 101*a*2 is an example embodiment that corresponds to the "exposed region" according to the present invention. The first covered region 101*a*1 is an example embodiment that corresponds to the "first covered region" according to the present invention. The output axis 111*a* is an example embodiment that corresponds to the "output axis" according to the present invention. The second covered region 101*b*1 is an example embodiment that corresponds to the "second covered region" according to the present invention. The striking mechanism 140 is an example embodiment that corresponds to the "striking mechanism" according to the present invention. The vibration-proofing mechanism 180 is an example embodiment that corresponds to the "vibration-proofing mechanism" according to the present invention. The biasing member 181 is an example embodiment that corresponds to the "biasing member" according to the present invention. The rotation axis 182 is an example embodiment that corresponds to the "rotation axis" according to the present invention. The restricting part 190 is an example embodiment that corresponds to the "restricting part" according to the present invention. The center of gravity 100*c* is an example embodiment that corresponds to the "center of gravity" according to the present invention. The pivot member 182*c* is an example embodiment that corresponds to the "pivot member" according to the present invention. The sliding guide 193 is an example embodiment that corresponds to the "guide" according to the present invention. The first region 100*a* is an example embodiment that corresponds to the "first region" according to the present invention. The second region 100*b* is an example embodiment that corresponds to the "second region" according to the present invention. The long-distance moving region 200 is an example embodiment that corresponds to the "long-distance moving region" according to the present invention. The air circulation preventing mechanism 300 is an example embodiment that corresponds to the "air circulation preventing mechanism" according to the present invention. The motor intake port 303 is an example embodiment that corresponds to the "intake port" according to the present invention. The motor exhaust port 304 is an example embodiment that corresponds to the "exhaust port" according to the present invention. The wall-like member 310 is an example embodiment that corresponds to the "wall-like member" according to the present invention. The overlap region 400 is an example embodiment that corresponds to the "overlap region" according to the present invention. The flexible member 411 is an example embodiment that corresponds to the "flexible member" according to the present invention. The sliding region 420 is an example embodiment that corresponds to the "sliding region" according to the present invention.

DESCRIPTION OF NUMERALS

100 hammer drill (impact tool)
100*a* first region
100*b* second region
100*c* center of gravity
101 body (tool body)
101*a* first body element
101*a*1 first covered region
101*a*2 first exposed region (exposed region)
101*aa* rear edge
101*ab* opening
101*ac* cylindrical part
101*b* second body element
101*b*1 second covered region
100*b*2 second exposed region
101*b*3 support plate
101*ba* open front end region
101*bb* main region
101*bc* stepped part
101*bd* right-side second body element
101*be* left-side second body element
101*bf* insertion region
101*c* fastening member
101*d* bumper
103 motor housing
104 inner housing
104*a* biasing member support part
104*b* fastening member
105 gear housing
109 handgrip (handle)
109*a* trigger
109*b* switch
110 electric motor (driving motor)
110*a* motor case (motor holding part)
110*b* fastening member
111 shaft
111*a* output axis
111*b* pinion gear
119 hammer bit (tool accessory)
120 motion converting mechanism
121 intermediate shaft
122 bevel gear
123 rotating element
125 swinging member
125*a* bearing
127 piston
127*a* air chamber
129 cylinder
140 striking mechanism
140*a* central striking axis
143 striker
145 impact bolt
150 rotating power transmitting mechanism
151 first gear
153 second gear
159 tool holder (tool accessory mounting part)
159*a* bit insertion hole
160 battery mounting part
161 battery pack (battery)
170 switching mechanism
171 operation dial
180 vibration-proofing mechanism
181 biasing member

182 rotation axis
182*a* first pivot support part
182*b* second pivot support part
182*c* pivot member
190 restricting part
191 first restricting region
191*a* front wall
191*b* extending part
191*c* rear wall
192 second restricting region
192*a* front rib
192*b* intermediate rib
192*c* rear rib
193 sliding guide (guide)
200 long-distance moving region
210 short-distance moving region
300 air circulation preventing mechanism
301 body intake port
302 body exhaust port
303 motor intake port (intake port)
304 motor exhaust port (exhaust port)
305 fan
306 motor case intake port
307 motor case exhaust port
310 wall-like member
311 first wall-like member
311*a* extension plane
312 second wall-like member
312*a* extension plane
320 rotation allowing space
400 overlap region
410 flexible member arrangement region
410*a* front protruding part
410*b* rear protruding part
411 flexible member
411*a* projection
411*b* recess
411*c* extending part
411*d* protrusion
420 sliding region
430 dust-proofing mechanism

The invention claimed is:

1. An impact tool, which performs a hammering operation on a workpiece by linearly driving a tool accessory, comprising:

a housing comprised of a first body element and a second body element;

a tool accessory mounting part that extends in a longitudinal direction;

a driving motor that has an output axis crossing the longitudinal direction;

a striking mechanism that is driven by output of the driving motor and has a striking axis parallel to the longitudinal direction;

a handle designed to be held by a user;

a battery mounting part configured to receive and retain a battery for supplying current to the driving motor;

a biasing member that biases the first and second body elements; and a vibration-proofing mechanism for reducing vibration which is caused by driving of the striking mechanism; wherein:

the driving motor and the striking mechanism are supported by the first body element;

the handle and the battery mounting part are supported by the second body element;

the vibration-proofing mechanism causes the first and second body elements to reciprocate away from and toward each other via the biasing member when vibration is caused by driving of the striking mechanism;

the first body element and the second body element are configured to define a first region and a second region between portions of the first body element and the second body element;

the first region forms a long-distance moving region in which the first and second body elements move a longer distance toward each other in the longitudinal direction than in the second region;

the first body element has a first covered region that is entirely covered by the second body element and an exposed region that is not covered by the second body element;

the driving motor is provided in the first covered region;

the first body element and the second body element are configured to rotate around a rotation axis relative to each other;

the rotation axis is parallel to an axis that is transverse to the striking axis; and the rotation axis intersects the driving motor.

2. The impact tool as defined in claim 1, wherein:

the impact tool has a center of gravity with the battery mounted on the battery mounting part, and the rotation axis is closer to the center of gravity than to the striking axis.

3. The impact tool as defined in claim 1, wherein:

the first body element includes a motor holding part; and the driving motor is disposed in the motor holding part.

4. The impact tool as defined in claim 3, wherein:

the motor holding part includes a pivot member; and the second body element is pivotable with respect to the first body element about the pivot member.

5. The impact tool as defined in claim 1, wherein the second body element has a second covered region which is covered by the first body element.

6. The impact tool as defined in claim 1, wherein a direction in which the biasing member biases the first and second body elements coincides with the striking axis.

7. The impact tool as defined in claim 1, comprising a restricting part for restricting movement of the first and second body elements toward each other, the restricting part being formed inside the housing.

8. The impact tool as defined in claim 7, wherein the restricting part also serves as a guide for guiding movement of the first and second body elements with respect to each other.

9. The impact tool as defined in claim 2, further comprising an air circulation preventing mechanism located in the housing; wherein:

the driving motor has an intake port in one end region and an exhaust port in a second end region, and the air circulation preventing mechanism is provided between the intake port and the exhaust port and is configured to prevent circulation of air between the intake port and the exhaust port.

10. The impact tool as defined in claim 9, wherein the air circulation preventing mechanism comprises a wall-like member, and the rotation axis is located on an extension plane of the wall-like member.

11. The impact tool as defined in claim 5, wherein:

the first and second body elements have an overlap region where the first and second body elements overlap each other, and the overlap region has a flexible member which is disposed in one of the first and second body elements and a sliding region which is formed in the other of the first and second body elements and on which the flexible member slides when the first and second body elements reciprocate with respect to each other.

12. The impact tool as defined in claim 11, wherein the flexible member forms one of the first and second covered regions.

13. The impact tool as defined in claim 11, wherein the flexible member is formed in the second body element.

14. The impact tool as defined in claim 11, wherein the flexible member is configured to be deformed by the first or second body element having the sliding region when the first and second body elements are assembled together.

15. The impact tool as defined in claim 11, wherein the flexible member is integrally formed with the one of the first and second body elements in the overlap region.

16. The impact tool as defined in claim 1, wherein the distance between the first body element and the second body element increases continuously from the second region to the first region.

17. The impact tool as defined in claim 1, wherein:

the first covered region includes a motor housing that houses the driving motor;

the second body element and the first body element are pivotally connected by a pivot member; and the pivot member extends outwardly from the motor housing.

18. An impact tool, which performs a hammering operation on a workpiece by linearly driving a tool accessory, comprising:

a housing comprised of a first body element and a second body element;

a tool accessory mounting part that extends in a longitudinal direction;

a driving motor that has an output axis crossing the longitudinal direction;

a striking mechanism that is driven by output of the driving motor and has a striking axis parallel to the longitudinal direction;

a handle designed to be held by a user;

a battery mounting part configured to receive and retain a battery for supplying current to the driving motor;

a biasing member that biases the first and second body elements; and a vibration-proofing mechanism for reducing vibration which is caused by driving of the striking mechanism; wherein:

the driving motor and the striking mechanism are supported by the first body element;

the handle and the battery mounting part are supported by the second body element;

the vibration-proofing mechanism, the first body element and the second body element are configured such that the first body element and the second body element rotate around a rotation axis relative to each other when vibration is caused by driving of the striking mechanism;

the first body element has a first covered region that is entirely covered by the second body element and an exposed region that is not covered by the second body element;

the driving motor is provided in the first covered region;

the rotation axis is parallel to an axis that is transverse to the striking axis; and the rotation axis intersects the driving motor.

19. The impact as defined in claim 18, the first covered region includes a motor housing that houses the driving motor;

the second body element and the first body element are pivotally connected by a pivot member; and the pivot member extends outwardly from the motor housing.

* * * * *